US007148885B2

(12) United States Patent
Nose

(10) Patent No.: US 7,148,885 B2
(45) Date of Patent: Dec. 12, 2006

(54) DISPLAY DEVICE AND METHOD FOR DRIVING THE SAME

(75) Inventor: Takashi Nose, Kanagawa (JP)

(73) Assignee: NEC Electronics Corporation (JP)

( * ) Notice: Subject to any disclaimer, the term of this patent is extended or adjusted under 35 U.S.C. 154(b) by 394 days.

(21) Appl. No.: 10/453,020

(22) Filed: Jun. 3, 2003

(65) Prior Publication Data

US 2003/0227428 A1 Dec. 11, 2003

(30) Foreign Application Priority Data

Jun. 7, 2002 (JP) ..... 2002-167109

(51) Int. Cl.
*G09G 3/36* (2006.01)
*G09G 5/00* (2006.01)

(52) U.S. Cl. ..... 345/209; 345/99; 345/100

(58) Field of Classification Search ..... 345/90, 345/100, 94, 92, 96, 98, 99, 103, 690, 694, 345/209

See application file for complete search history.

(56) References Cited

U.S. PATENT DOCUMENTS 5,867,141 A * 2/1999 Asada et al. ..... 345/100
6,046,717 A * 4/2000 Taniguchi et al. ..... 345/96
6,313,818 B1 * 11/2001 Kondo et al. ..... 345/89
6,388,653 B1 * 5/2002 Goto et al. ..... 345/98
6,473,077 B1 * 10/2002 Takenaka et al. ..... 345/209
6,583,779 B1 * 6/2003 Ushirono ..... 345/100
6,734,840 B1 * 5/2004 Fukutoku et al. ..... 345/96
6,940,481 B1 * 9/2005 Konno et al. ..... 345/96
2004/0017342 A1 * 1/2004 Sekine ..... 345/87

FOREIGN PATENT DOCUMENTS

JP 2000-122596 4/2000

OTHER PUBLICATIONS

Kurita, "Degradation of Quality of Moving Images Displayed on Hold Type Displays", NHK Science and Technical Research Laboratories, 1999 IEICE General Conference, SC-8-1, pp. 207-208.

* cited by examiner

*Primary Examiner*—Henry N. Tran
(74) *Attorney, Agent, or Firm*—Hayes Soloway P.C.

(57) ABSTRACT

Pixel data and black image data are simultaneously and respectively written to two pixels positioned in different pixel rows and this operation is performed two times on each of the different pixel rows to write corresponding data to all pixels in each of the different pixel rows. When the above operation is performed on all pixel rows within one frame period, a data latch circuit may hold only half the number of data that have to be held in the data latch circuit of the conventional signal line driving circuit, resulting in reduction in the size of data latch circuit chip and reduction in space occupied by a display device.

18 Claims, 24 Drawing Sheets

ILLUSTRATION HOW PIXEL DATA ARE WRITTEN ACCORDING TO CONVENTIONAL DRIVING-SYSTEM

ILLUSTRATION HOW PIXEL DATA/ BLACK IMAGE DATA ARE WRITTEN ACCORDING TO CONVENTIONAL METHOD

OUTPUT SECTION CONFIGURATION 1 OF CONVENTIONAL SIGNAL- LINE DRIVING CIRCUIT

ILLUSTRATION HOW PIXEL DATA/ BLACK IMAGE DATA ARE WRITTEN
( CORRESPONDING TO FIG. 15 )

SYMBOL s DENOTES A INTEGER (S<m1)

ILLUSTRATION HOW PIXEL DATA/ BLACK IMAGE DATA ARE WRITTEN
( CORRESPONDING TO FIG. 19)

OUTPUT- SECTION CONFIGURATION 1 OF SIGNAL- LINE DRIVING CIRCUIT OF THE PRESENT INVENTION
(CORRESPONDING TO FIG. 15)

OUTPUT- SECTION CONFIGURATION 2 OF SIGNAL- LINE DRIVING CIRCUIT OF THE PRESENT INVENTION
(CORRESPONDING TO FIG. 15)

OUTPUT- SECTION CONFIGURATION 3 OF SIGNAL- LINE DRIVING CIRCUIT OF THE PRESENT INVENTION
(CORRESPONDING TO FIG. 19)

OUTPUT- SECTION CONFIGURATION 4 OF SIGNAL- LINE DRIVING CIRCUIT OF THE PRESENT INVENTION
(CORRESPONDING TO FIG. 19)

DISPLAY DEVICE AND METHOD FOR DRIVING THE SAME

BACKGROUND OF THE INVENTION

1. Technical Field of the Invention

The present invention relates to a circuit for driving a display device, particularly to a display device for solving the image-retention phenomenon of a liquid-crystal display.

2. Description of the Related Art

As liquid-crystal displays (hereafter referred to as LCD) having larger sizes and higher definitions become available, their application is becoming common in displays for still images such as liquid-crystal displays used in computers and word processors as well as displays for moving images such as liquid-crystal displays used in TVs or the like. An LCD is slim compared to a TV having a CRT (Cathode Ray Tube) and it can be set without occupying a large space. Therefore, it is expected that more and more households will use LCDs. An LCD typically uses so-called AC driving to prevent liquid crystal deterioration, in which the LCD is controlled so that a DC-component voltage is not being applied to liquid crystal for a long period of time. To perform the AC driving, there is a method of alternately applying positive-polarity and negative-polarity signal voltages to a pixel electrode while keeping a voltage to be applied to a common electrode constant.

FIG. 1 is an illustration showing a configuration of an active matrix substrate of a conventional liquid-crystal panel. n (n is an integer) scanning lines 101 and m (m is an integer) signal lines 102 are arranged on the active matrix substrate and a TFT (Thin Film Transistor) 103 serving as a nonlinear device (switching device) is disposed near each of intersections of scanning lines 101 and signal lines 102.

The TFT 103 has a gate electrode connected to the scanning line 101, a source electrode connected to the signal line 102, and a drain electrode connected to a pixel electrode 104. The pixel electrode 104 constitutes a pixel capacitor 108 so as to interpose liquid crystal (not illustrated) between the pixel capacitor and a common electrode 105 disposed on an opposing substrate that faces the active matrix substrate.

The scanning lines 101 are connected to a scanning-line driving circuit 106 and the signal lines 102 are connected to a signal-line driving circuit 107. The scanning-line driving circuit 106 is operable to sequentially supply high potential to the n scanning lines 101 to turn on the TFTs connected to the scanning lines 101 as shown in FIG. 2. For a duration of scanning operation of the scanning-line driving circuit 106, the signal-line driving circuit 107 outputs a gray scale voltage VD corresponding to image data to any one of the m signal lines and thereby, supplying the gray scale voltage to the pixel electrode 104 through the turned-on TFT 103. The gray scale voltage serves to generate a potential difference between the common electrode 105 and the pixel electrode 104 to which a constant voltage is being applied and the potential difference generates an electric field so that the quantity of light passing through liquid crystal is controlled by an electric field, thereby resulting in display of image (Data denoted as <1> to <3> in FIG. 3 represents the pixel data in the first to third columns). Thus, the liquid-crystal panel is driven as shown in FIG. 4.

When displaying a moving image on the liquid-crystal display panel, currently, image-quality deterioration such as an image-retention phenomenon unfavorably occurs.

FIG. 5 shows how a speed at which liquid crystal responds to an image signal supplied thereto affects the brightness of the display panel. Because a speed at which a liquid-crystal material responds is low, when a gray scale voltage changes, liquid crystal cannot follow the change of gray scale voltage within one frame period and therefore, liquid crystal comes to response to the change over a several frame periods. This potentially causes the image-retention phenomenon. To solve the above problem, a variety of liquid crystal materials have been developed.

However, the report is conducted as follows by analyzing the aforementioned problem of image-retention phenomenon. That is, the study conducted by Japan Broadcasting Corporation Science and Technical Research Laboratory (for example, refer to the 1999 IEICE General Conference, SC-8-1, pp. 207–208) teaches that only the speed at which liquid crystal responds to an image signal is not responsible for occurrence of image-retention phenomenon, but the display scheme through which an LCD displays an image is also responsible for it. The problem found in the display scheme employed in an LCD will be described below by comparing the CRT driving method with the LCD driving method.

A liquid-crystal display is made to operate in accordance with the technique for sequentially driving lines in a direction from top to bottom lines as shown in FIGS. 2 and 3 and is a hold-type display device for holding a display image during one frame period. Because the liquid-crystal display device is operable to hold a display image during one frame period, a time difference occurs between a time interval during which an image is being displayed and a time interval during which a viewer moves its eyes on the image being displayed, causing an unclear image movement.

FIGS. 6(*a*) and 6(*b*) are presented to illustrate how a pixel of each of a CRT and an LCD emits light for image display in response to an image signal in the time domain.

As shown in FIG. 6(*a*), the CRT is the so-called impulse-type display device which emits light only for several milliseconds after an electron beam hits the fluorescent material on the surface of a tube. In contrast, the LCD shown in FIG. 6(*b*) is the so-called hold type display device for holding light for image display for one frame period ranging from the time when writing of data to pixels is completed to the time when the subsequent writing starts.

As shown in FIG. 6(*a*), when the CRT having the above characteristics and serving as an impulse-type display device displays a moving image, an object to be displayed is momentarily displayed at a position corresponding to the time at which the object is to be displayed. In contrast, when the LCD having the above characteristics and serving as a hold-type display device displays an image while keeping the image during one frame period, leaving the image until before beginning of writing of new data and causing an unclear image movement.

To prevent the unclear image movement, a liquid-crystal panel capable of quickly responding to an image signal has been developed and further, a driving method for displaying a moving image is disclosed in Japanese Patent No. 2000-122596 and the like. To prevent the unclear movement observed particularly in the hold-type display device, the driving method shown in FIGS. 7 and 8 is made available to the liquid-crystal active matrix substrate in FIG. 1.

The driving method shown in FIG. 7 or 8 is a method of resetting eyes and preventing an unclear image movement by inserting a black image during one frame period.

An image-retention phenomenon is avoided using the method in FIG. 7 or 8 comprising: writing image data to all the pixels of a certain pixel row as shown in FIG. 9; and at the same time, applying a black display voltage to all the pixels of another pixel row positioned apart a plurality of rows from the certain pixel row.

FIG. 10 shows an image displayed by driving liquid crystal using the method shown in FIGS. 2, 3 and FIG. 11 shows an image displayed by driving liquid crystal using the method shown in FIGS. 7, 8. As shown in FIG. 11, scanning a black display region is scanned over the screen eyes resets viewer's eyes and eliminates an unclear movement of moving image.

However, even if the an unclear movement of moving image is prevented by using the above signal-line driving method, the manufacture of a signal-line driving circuit still largely contributes to an increase in the cost of a liquid-crystal display even in a current situation in which there is strong requirement for cost reduction in the liquid-crystal display. Therefore, it is an important challenge to prevent an unclear movement of moving image and also reduce a signal-line driving circuit chip in size.

FIG. 12 shows the configuration of a conventional signal-line driving circuit. As shown in FIG. 12, the signal-line driving circuit is constituted by a shift register section 150, data register section 151, latch section 152, D/A converter section 153, and output buffer section 154. Image data is input through data buses (R0–R7, G0–G7, and B0–B7) and image data corresponding to the number of signal lines (image data corresponding to m pixels) are stored in the latch section 152. The stored image data corresponding to the signal lines are converted by the D/A CO converter section 153 into voltages adjusted to the transmittance performance of a liquid-crystal panel and output from the output buffer 154.

Symbol STH denotes a start pulse signal, HCK denotes a horizontal clock signal, STB denotes an output timing signal, POL denotes an output polarity inversion signal, and V0 to V9 each denote a reference gray scale voltage.

FIG. 13 shows the detailed output-section configuration of a signal-line driving circuit. Because positive-polarity signal voltage and negative-polarity signal voltage are alternately applied to a signal line, DAC+ for outputting a positive-polarity gray scale voltage indicative of image data and DAC− for outputting a negative-polarity voltage indicative of image data are arranged in the D/A converter section to realize AC driving by switching multiplexers 200 and 201 provided respectively in the latching section and output buffer section in response to a STB signal (or POL signal)

For example, the image data to be supplied to D1 is stored in the leftmost LAT in FIG. 13 and converted by the DAC+ or DAC−, which is determined by the multiplexer 200, and then, the image data is selected by the multiplexer 201 and output to D1 through an output amplifier 170. Note that the image data stored in the leftmost LAT never is output to D2.

Moreover, an output-section configuration of the conventional signal-line driving circuit may have the configuration shown in FIG. 14.

As described above, because the conventional signal-line driving circuit is constituted so as to hold the image data corresponding to signal lines (image data corresponding to m pixels) and then simultaneously output the image data to the signal lines, the number of outputs to signal lines substantially determines the size of signal-line driving circuit chip.

The techniques shown in FIGS. 7 to 9 still employ the method in which a signal-line driving circuit holds image data corresponding to signal lines and then outputs the data, thereby providing a configuration different from the scale-downed signal-line driving circuit configuration.

SUMMARY OF THE INVENTION

It is an object of the present invention to provide a method for driving a display device capable of preventing an unclear movement of moving image and reducing the size of a signal-line driving circuit chip and a display device driving circuit using the method.

According to one aspect of the invention, a method for driving a display device including a pixel array with pixels arranged in a matrix of rows and columns, comprising the steps of:

dividing a period of writing image data to at least one pixel row among pixel rows constituting the pixel array into a first scanning period and a second scanning period;

writing image data to pixels located in predetermined pixel columns in an optional pixel row during the first scanning period and further writing black image data to pixels located in pixel columns other than the predetermined pixel columns and included in a pixel row different from the optional pixel row; and writing image data to pixels excluding the pixels allowing image data to be written thereto and located in the optional pixel row during the first scanning period and further writing black image data in pixels excluding the pixels allowing the black image data to be written thereto and included in the pixel row during the first scanning period.

The above-described method for driving a display device is further constructed such that the pixel row allowing the black image data to be written thereto during the first scanning period and the pixel row allowing the black image data to be written thereto during the second scanning period are different from each other.

According to another aspect of the invention, a display device including a pixel array with pixels arranged in a matrix of rows and columns comprises:

a first scanning line for selecting one set of pixels in one pixel row, the one pixel row constituting the pixel array;

a second scanning line for selecting the other set of pixels in the one pixel row;

a scanning-line driving circuit for driving sets of first and second scanning lines in order from top to bottom within the pixel array, each set of first and second scanning lines corresponding to each of individual pixel rows of the pixel array;

a first set of signal lines for supplying a voltage corresponding to one of image data and black image data to pixels selected by the first scanning line out of one set of first and second scanning lines the second scanning line a second set of signal lines for supplying a voltage corresponding to one of image data and black image data to pixels selected by the second scanning line out of the one set of first and second scanning lines; and a signal-line driving circuit for driving the sets of first and second signal lines, the sets of first and second signal lines constituting entire signal lines;

wherein the scanning-line driving circuit simultaneously drives the first scanning line out of the one set of first and second scanning lines and a second scanning line the out of another set of first and second scanning lines and wherein the signal-line driving circuit simultaneously outputs one of voltages corresponding to image data and black image data to the first set of signal lines and the other thereof to the second set of signal lines, and wherein the signal-line driving circuit writes a voltage corresponding to image data and a voltage corresponding to black image data into pixels included in two pixel rows different from each other.

The above-described display device is further constructed such that a pair of a pixel selected by the first scanning line and a pixel selected by the second scanning line is disposed in each set of adjacent pixel columns, each pixel column out of the each set of adjacent pixel columns being consisting of a plurality of pixels.

The above-described display device is further constructed such that the number of each of the first and second sets of signal lines is made equal to half the number of the entire signal lines so that the number of pixels selected by a first signal line out of one set of first and second scanning lines and the number of pixels selected by a second signal line out of one set of first and second scanning lines become equal to each other.

The above-described display device is still further constructed such that the signal-line driving circuit comprises a shift register circuit having shift stages corresponding to half the number of the entire signal lines and storing image data sequentially input thereto while shifting locations to be allocated to the data within the shift register circuit, a latch circuit for latching all together image data corresponding to half the number of the entire signal lines and output from the shift stages of the shift register circuit and then outputting image data, a D/A converter for converting image data stored in the latch circuit and corresponding to half the number of the entire signal lines into gray scale voltages in a manner depending on characteristics of display device, and a buffer for outputting voltages corresponding to image data corresponding to half the number of the entire signal lines and output from the D/A converter to specific signal lines and outputting a voltage corresponding to black image data to signal lines other than the specific signal lines.

BRIEF DESCRIPTION OF THE DRAWINGS

FIG. 6(*b*) is presented to illustrate how a pixel of an LCD emits light for image display in response to an image signal in the time domain;

DETAILED DESCRIPTION OF THE PREFERRED EMBODIMENTS

FIGS. 15 to 18 show a schematic configuration of a display device and a driving method of the present invention.

Figure 15:
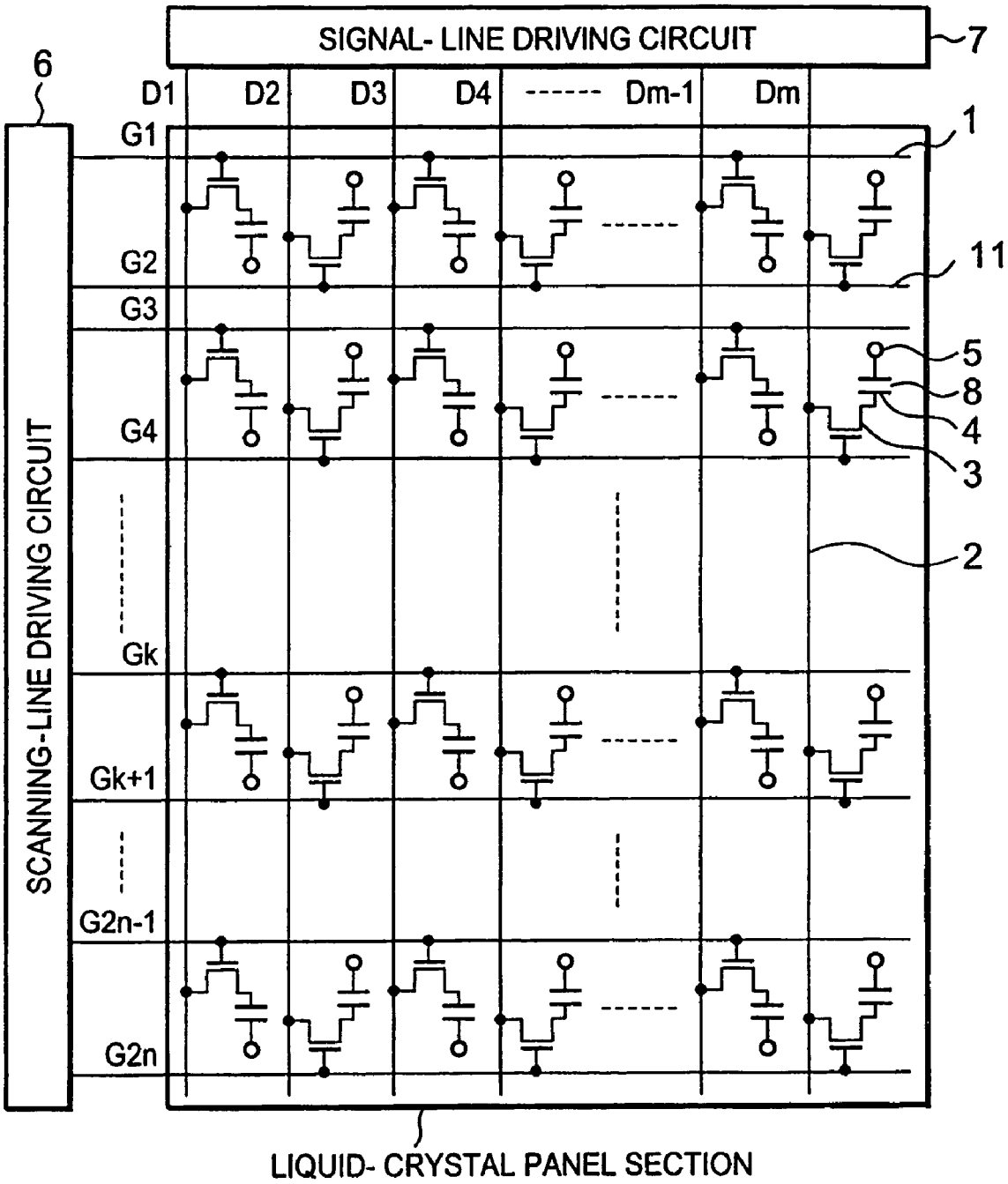
FIG. 15 is a schematic block diagram of a display device of an embodiment of the present invention.
Figure 16:
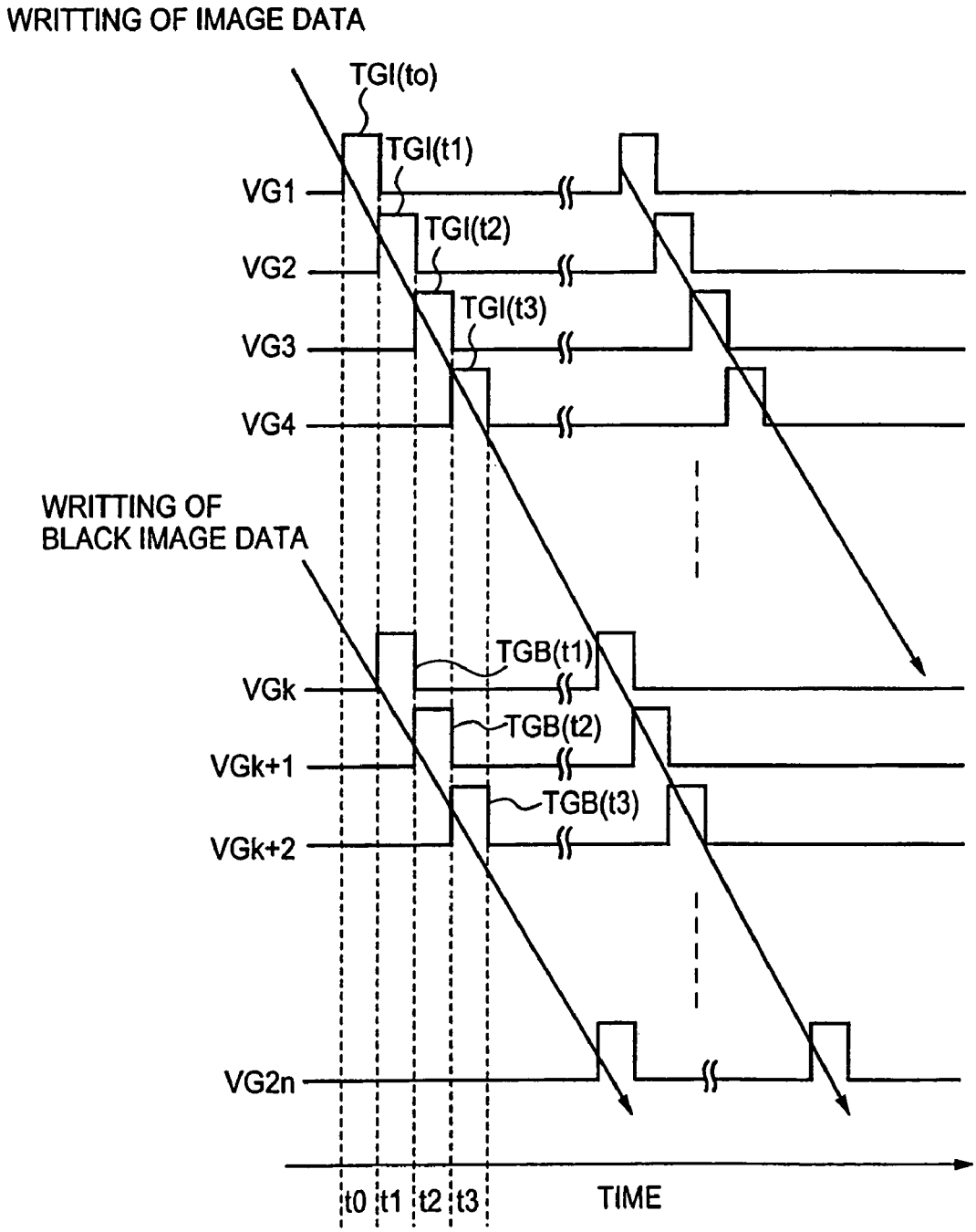
FIG. 16 is a timing chart illustrating how scanning lines are driven according to a driving method employed in an embodiment of the invention.

As shown in FIG. 15, pixels arranged in a direction parallel to a scanning line are constructed such that the TFTs of the pixels have their gate electrodes alternately connected to two scanning lines 1 and 11 in a direction parallel to the scanning line. As shown in FIG. 16, a scanning signal supplied to a scanning line includes an image-data write pulse TGI during which the scanning line is selected to allow image data to be written to the corresponding pixel and a black image data write pulse TGB during which the scanning line is selected to allow black display data to be written to the corresponding pixel during one frame period.

Figure 17:
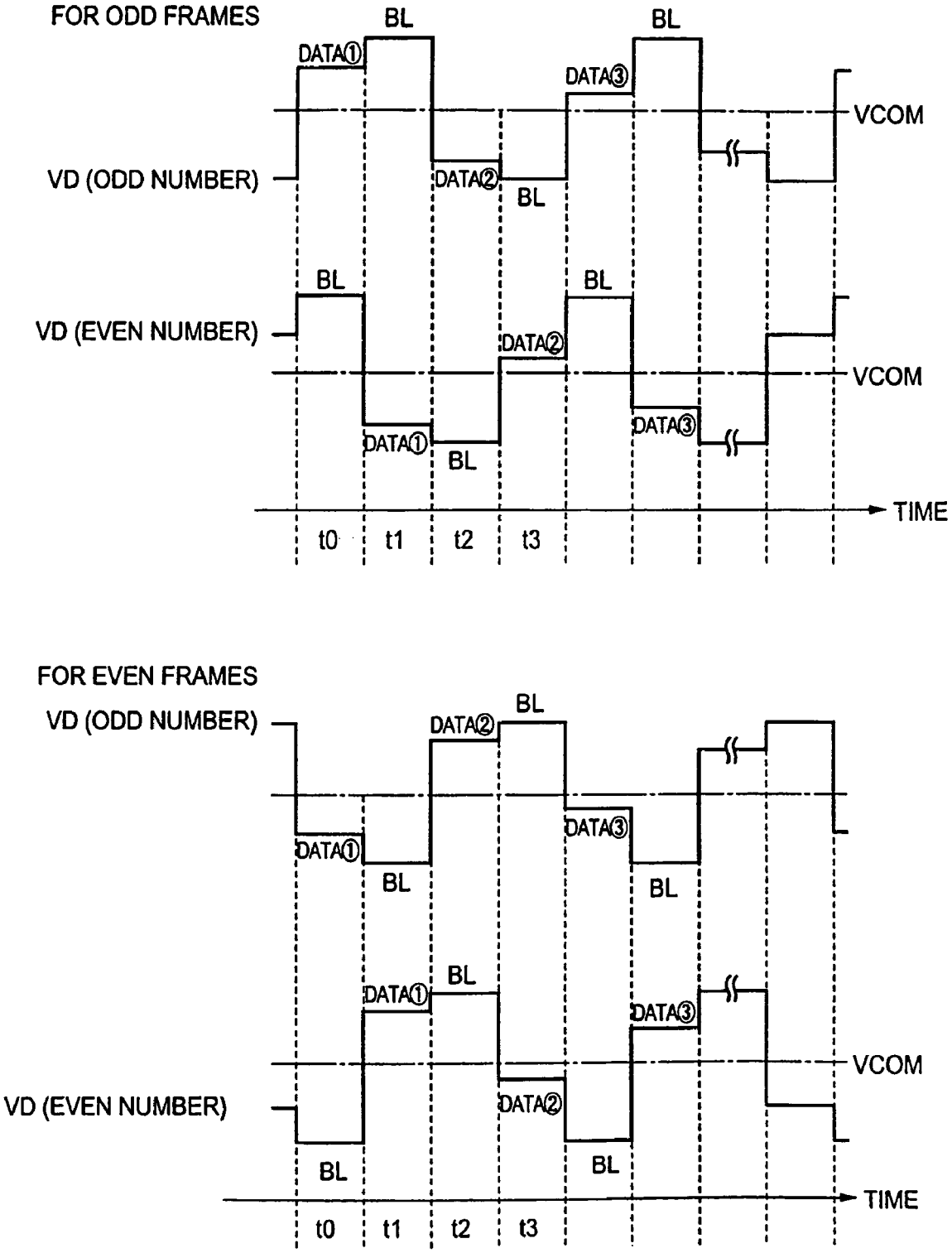
FIG. 17 is a timing chart illustrating how signal lines are driven according to a driving method employed in an embodiment of the invention.

Moreover, as shown in FIG. 17, a set of image data "Data" (Data denoted by <1> to <3> in FIG. 17 represent pixel data corresponding to first to third columns) and black "BL" is output from a signal-line driving circuit to each signal line 2 and each signal line 2 alternately outputs image data and black image data during each output period. The image data is written to pixels selected by the image-data writing pulse TGI and the black image data is written to pixels selected by the black image data write pulse TGB.

Figure 18:
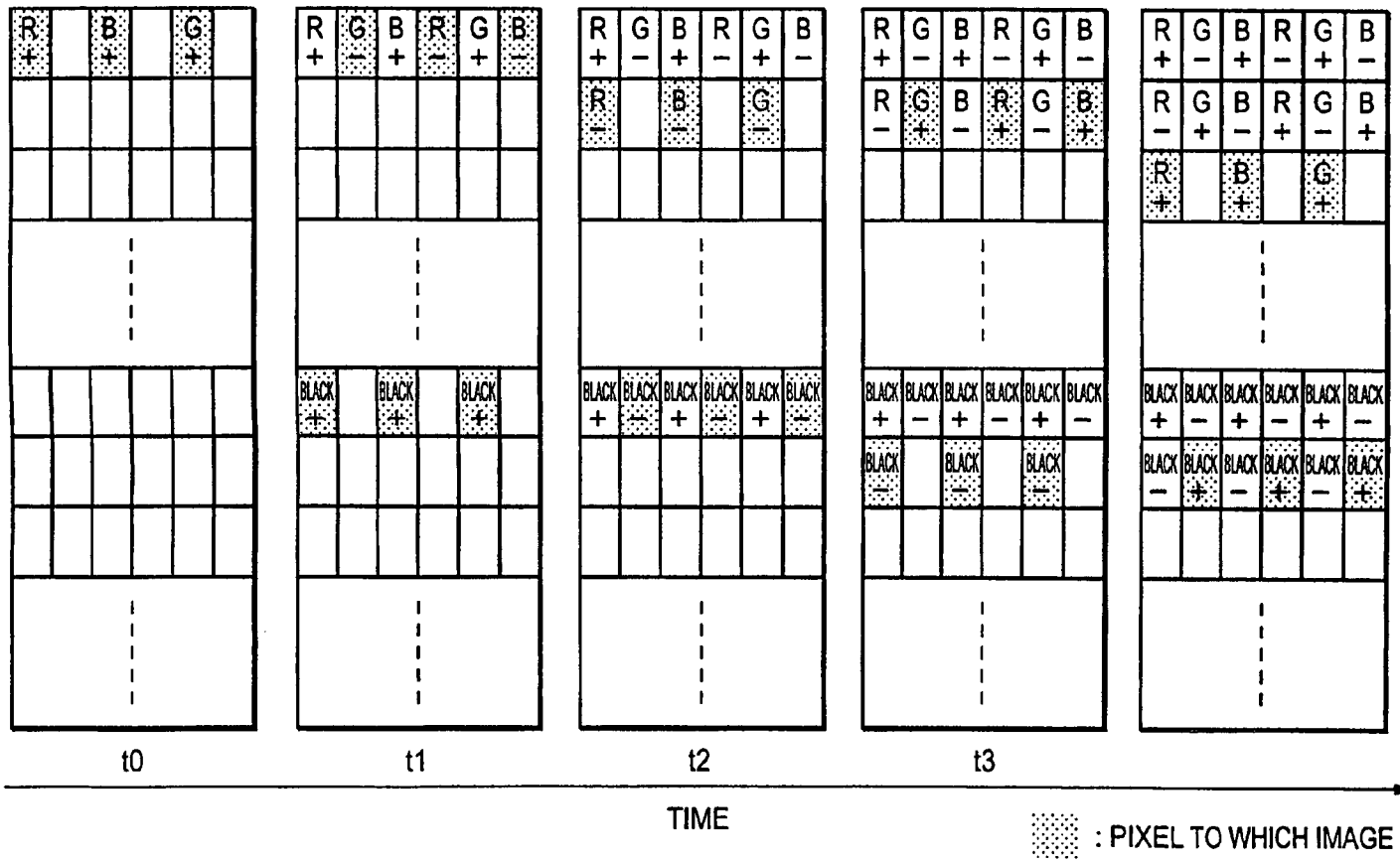
FIG. 18 is a schematic view showing how pixel data and black image data are written and associated images appear on a liquid crystal panel of the invention during one frame period.

FIG. 18 is a schematic view showing how image data and black image data are written to pixels on a liquid-crystal panel during one frame period.

When TGI (t0) is first applied to a scanning line VG(1) at time t0 as shown in FIG. 16, image data is displayed on the left pixel out of a pair of pixels in the first pixel row as shown in FIG. 18.

Then, when TGI (t1) is applied to a scanning line VG(2) and TGB (t1) is applied to a scanning line VG (k) ($2<k\leqq 2n-1$ and k is an odd number) at time t1, image data is displayed on the right pixel out of a pair of pixels in the first pixel row and at the same time, black image data is displayed on the left pixel out of a pair of pixels in the (k+1)/2-th pixel row as shown in FIG. 18.

Then, when TGI (t2) is applied to a scanning line VG(3) and TGB (t2) is applied to a scanning line VG (k+1) at time t2, pixel data is displayed on the odd-number-th pixels in the second pixel row and at the same time, black image data is displayed on the even-number-th pixels in the (k+1)/2-th pixel row.

Then, when TGI (t3) is applied to a scanning line VG(4) and TGB (t3) is applied to a scanning line VG(k+2) at time t3, pixel data is displayed on the even-number-th pixels in the second pixel row and at the same time, black image data is displayed on the odd-number-th pixels in the (k+3)/2-th pixel row as shown in FIG. 18.

Figure 7:
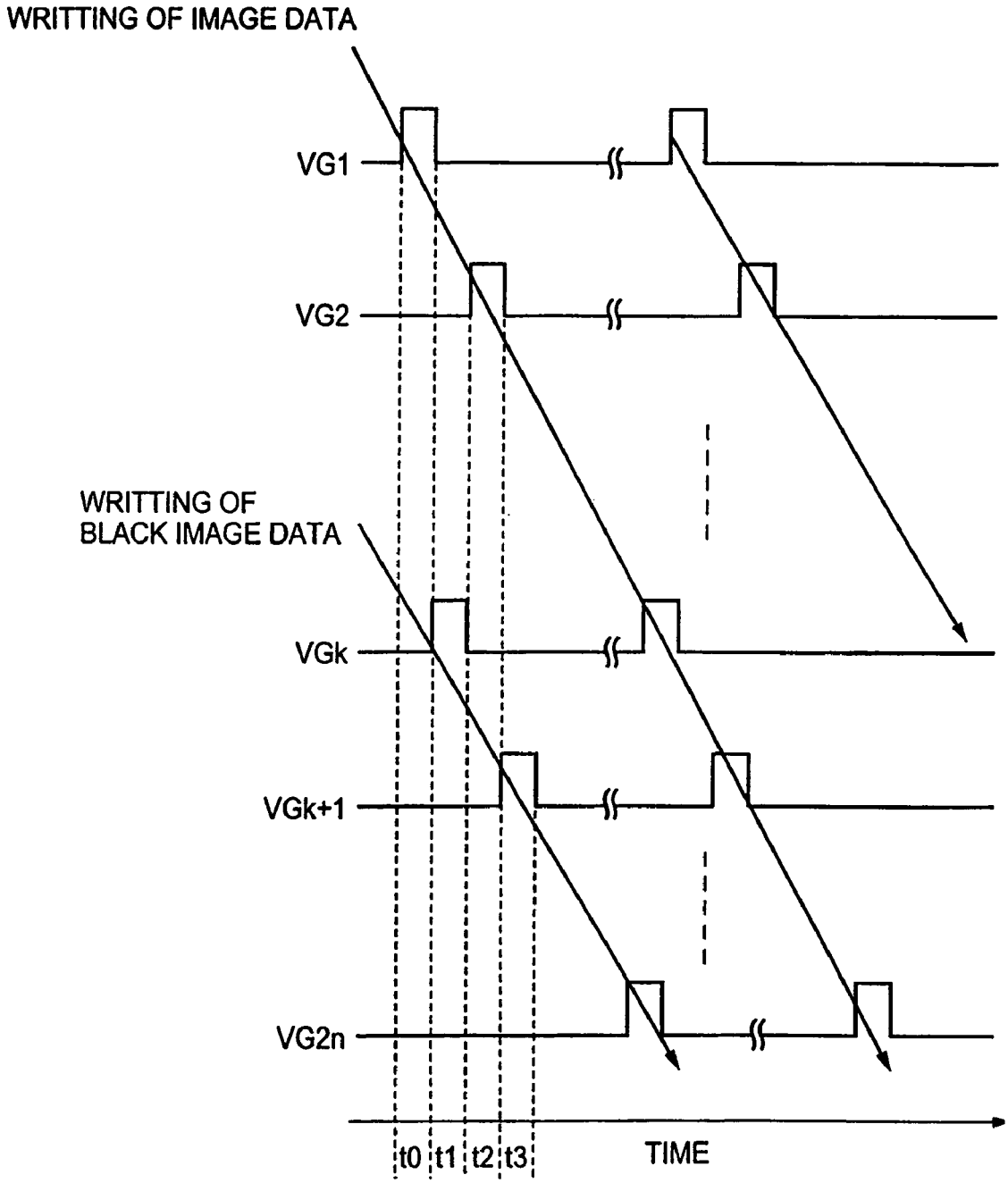
FIG. 7 (PRIOR ART)
FIG. 7 is a timing chart illustrating how scanning lines are driven according to a display device driving method used to prevent an unclear movement observed particularly in the hold-type display device.
Figure 8:
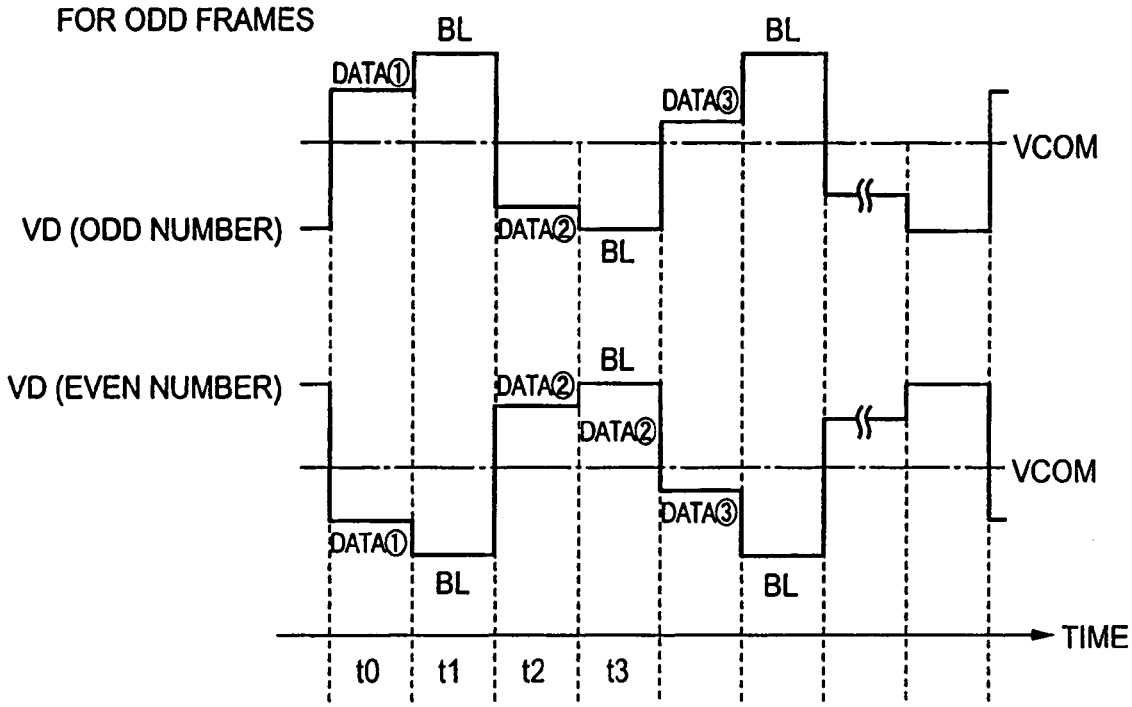
FIG. 8 (PRIOR ART)
FIG. 8 is a timing chart illustrating how signal lines are driven according to a display device driving method used to prevent an unclear movement observed particularly in the hold-type display device.
Figure 8:
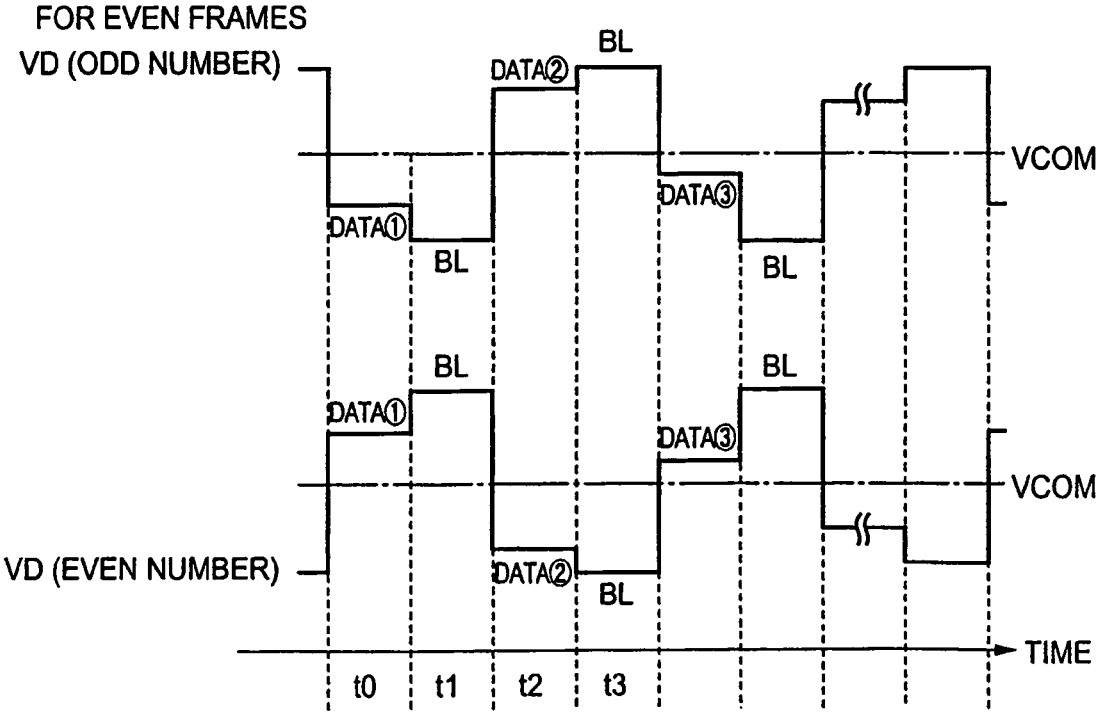
FIG. 8 (PRIOR ART)
Figure 9:
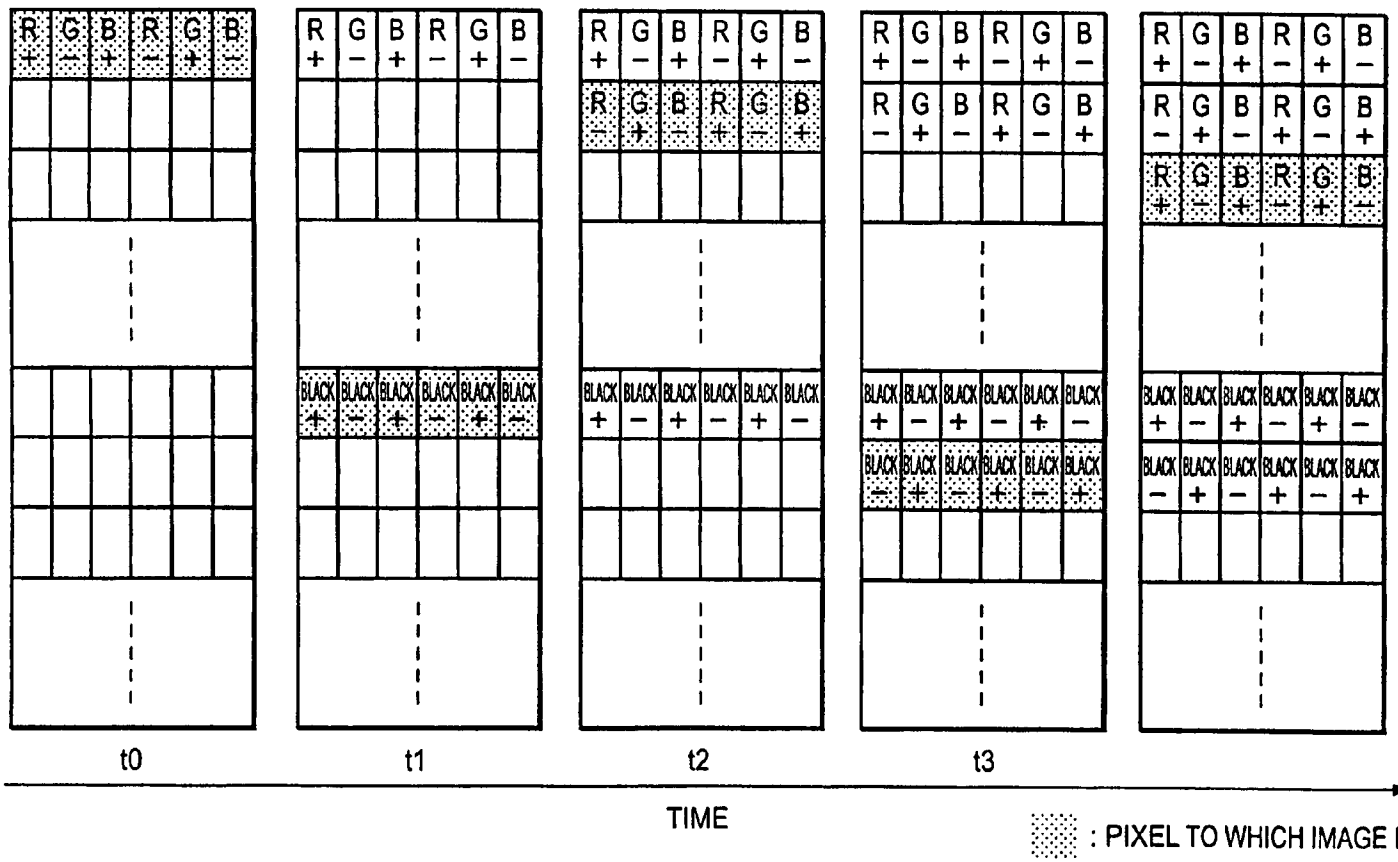
FIG. 9 (PRIOR ART)
FIG. 9 is a schematic view showing how pixel data and black image data are written according to a display device driving method to prevent an unclear movement observed particularly in the hold-type display device.
Figure 10:
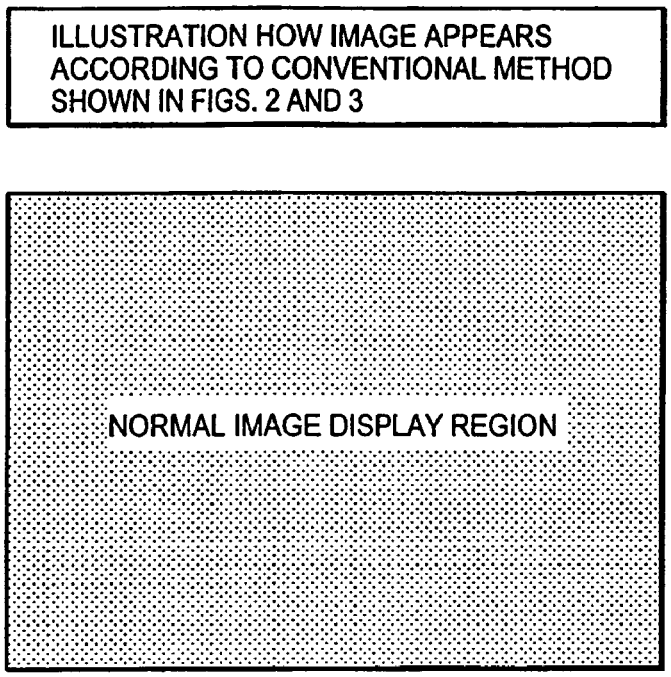
FIG. 10 (PRIOR ART)
FIG. 10 is an illustration showing how an image appears when employing the conventional driving method shown in FIGS. 2 and 3.
Figure 11:
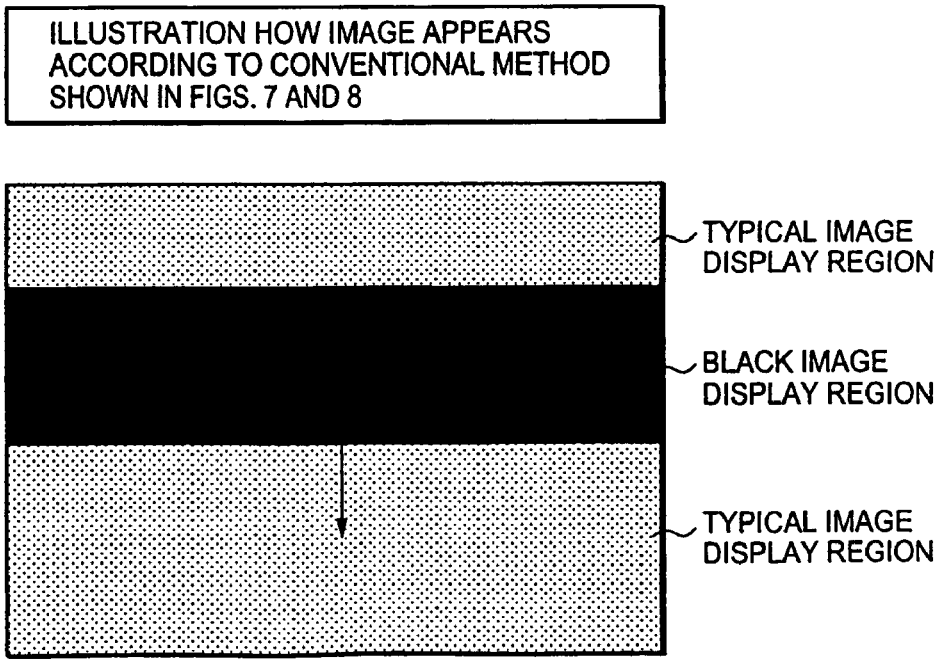
FIG. 11 (PRIOR ART)
FIG. 11 is an illustration showing how an image appears when employing the conventional driving method used to prevent an unclear movement observed particularly in the hold-type display device and shown in FIGS. 7 and 8.

The above operations are sequentially repeated. Employment of the circuit configuration shown in FIG. 15 and the driving method shown in FIG. 17 allows the liquid crystal panel to display an image (FIG. 11) having image quality equal to that achieved by employment of the conventional driving method (FIGS. 7 to 9) for preventing an unclear movement of moving image.

Figure 19:
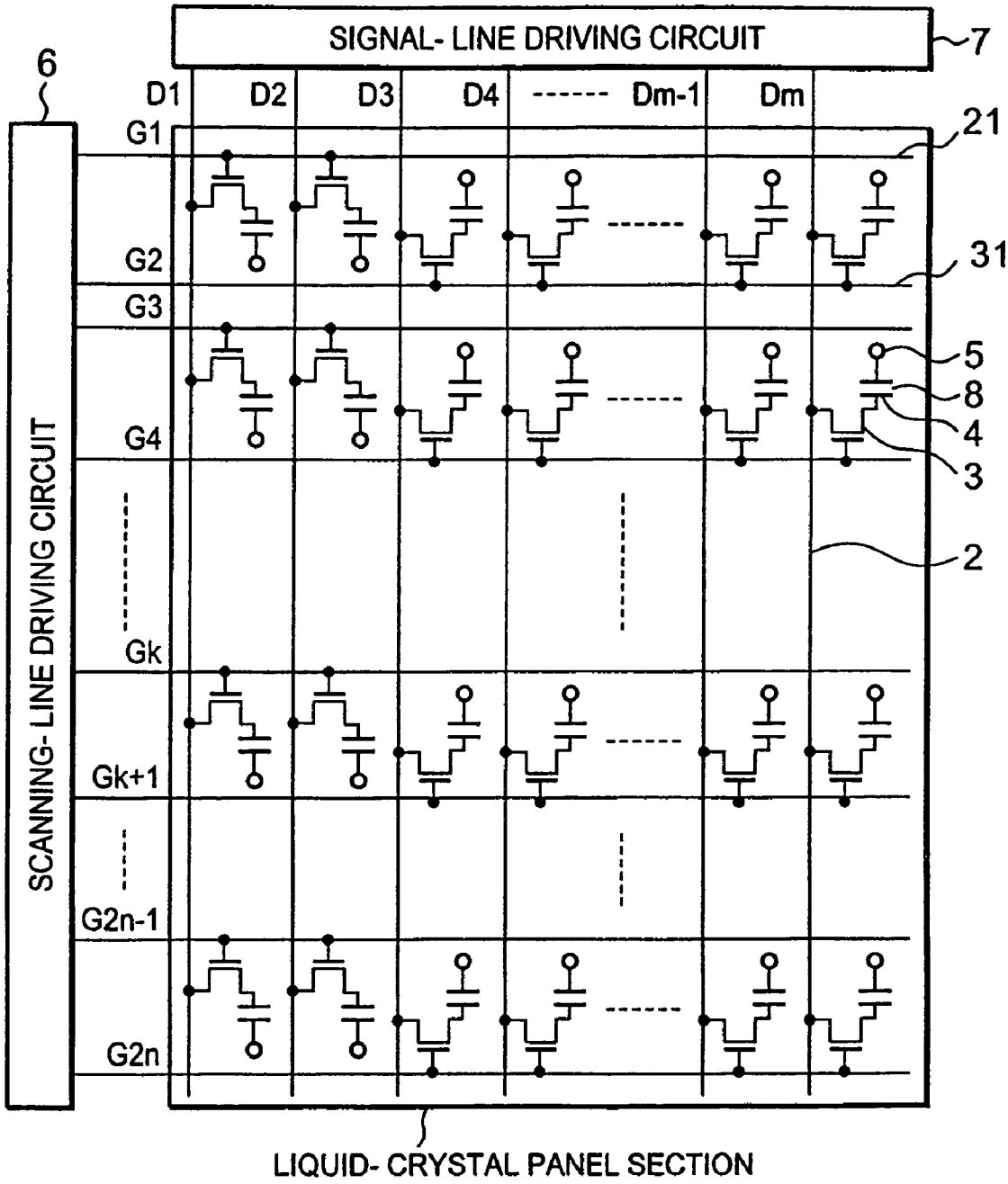
FIG. 19 is a schematic configuration of another display device circuit of the embodiment of the present invention.

It should be appreciated that the liquid crystal panel is configured to have a pair of adjacent pixels out of individual pixels in a pixel row alternately connected to two different scanning lines 21 and 31 as shown in FIG. 19.

Figure 20:
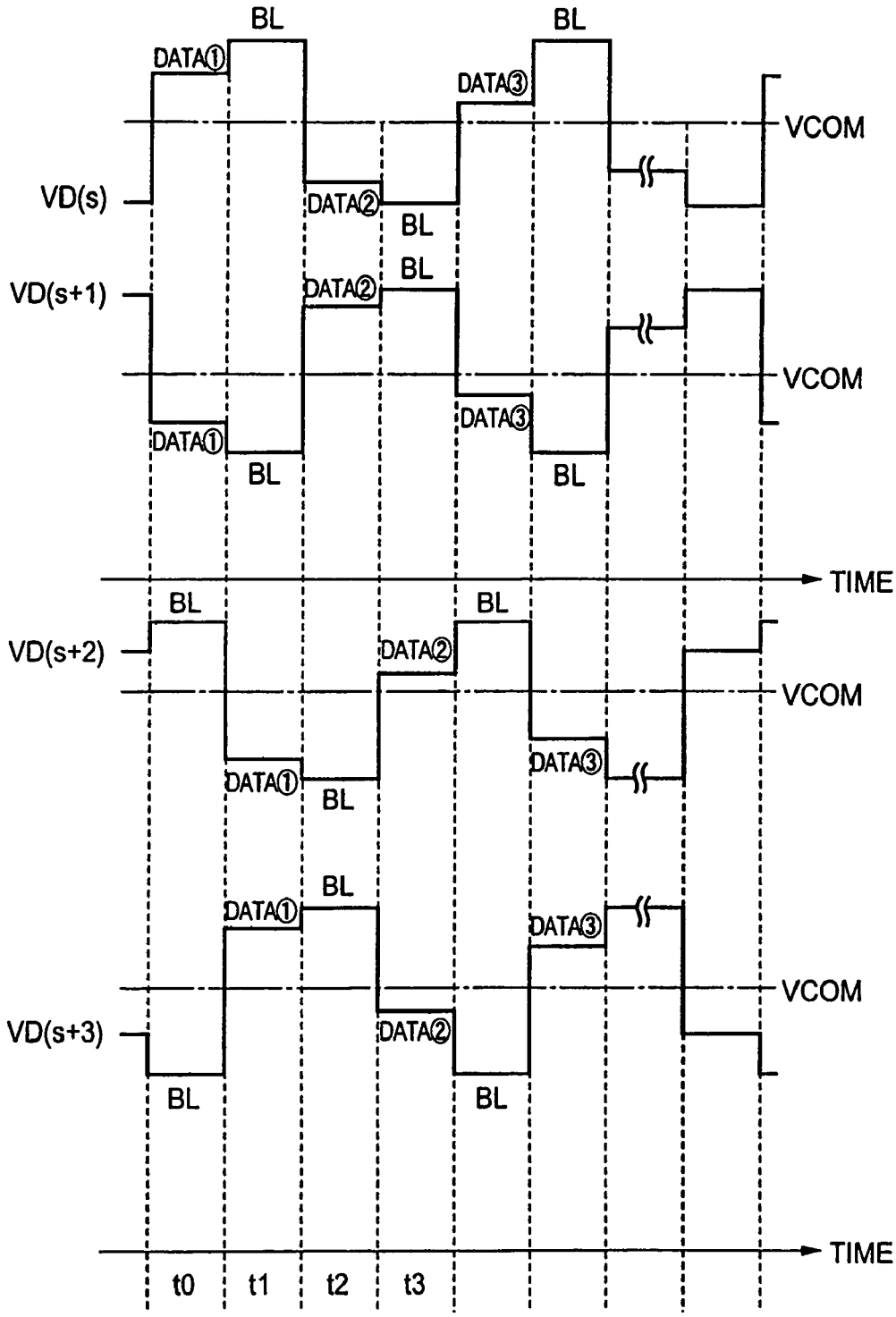
FIG. 20 is a timing chart illustrating how signal lines shown in FIG. 19 are driven according to a driving method employed in the embodiment of the invention.

When employing the configuration shown in FIG. 19, a set of image data "Data" (Data <1> to <3> denoted in FIG. 20 represent image data contained respectively in first to third rows) and black "BL" is output to a pair of adjacent signal lines 2 from a signal-line driving circuit as shown in FIG. 20 and each signal line 2 alternately outputs image data and black image data during each output period. {Note that signal-line voltages VD (s to s+3) shown in FIG. 20 are inverted every frame period. Symbol "s" denotes an integer.}

Figure 21:
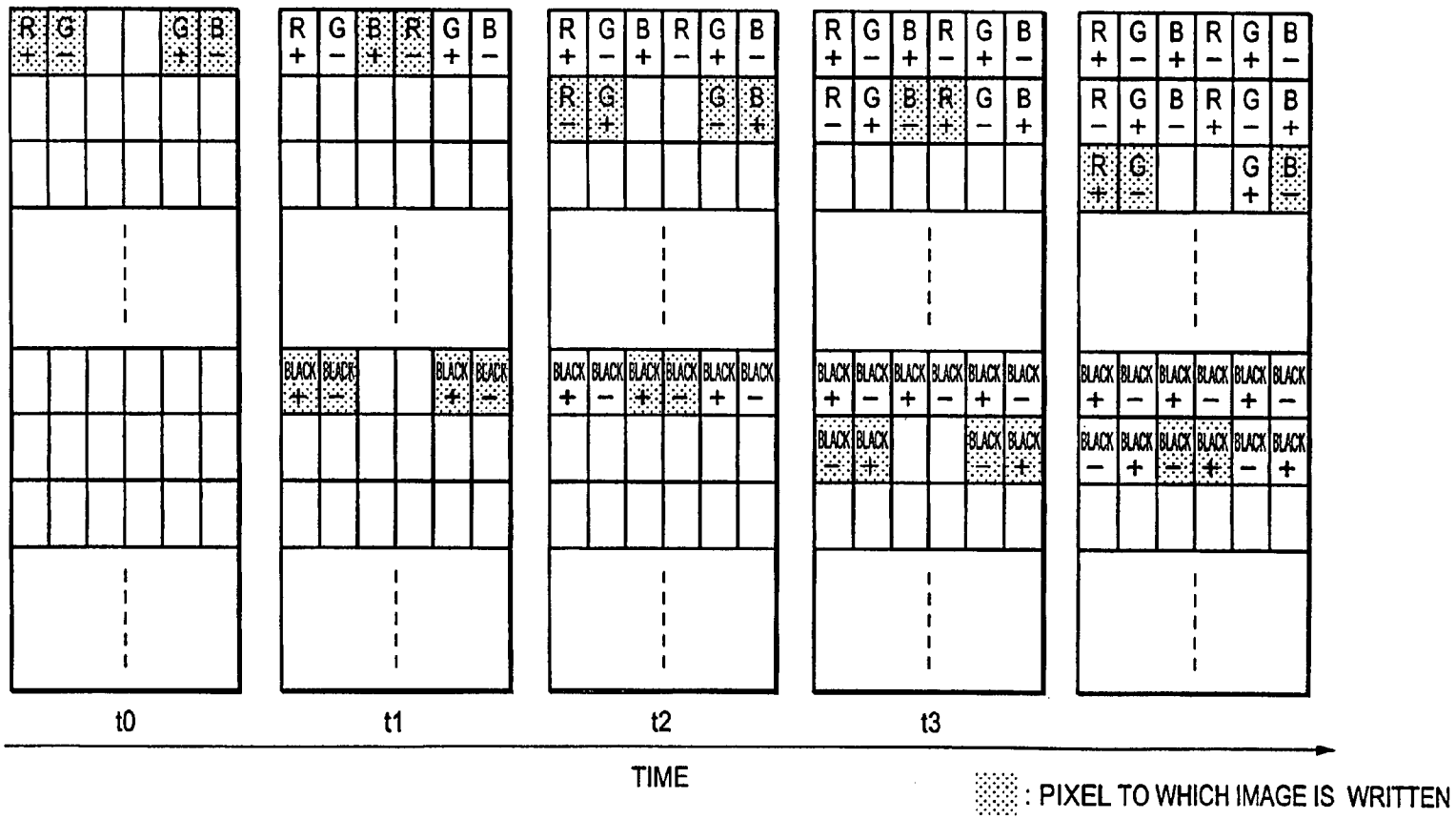
FIG. 21 is a schematic view showing how pixel data and black image data are written and associated images appear on a liquid crystal panel, shown in FIG. 19, of the embodiment of the invention during one frame period.

FIG. 21 is a schematic view showing how image data and black image data are written during one frame period on the liquid-crystal panel having the configuration shown in FIG. 19.

Employment of a configuration disclosed in the present invention ensures that a signal-line driving circuit outputs a gray scale voltage corresponding to pixel data to half of signal lines (m/2 lines) and simultaneously outputs a voltage corresponding to black image data to the remaining half of signal lines.

Figure 12:
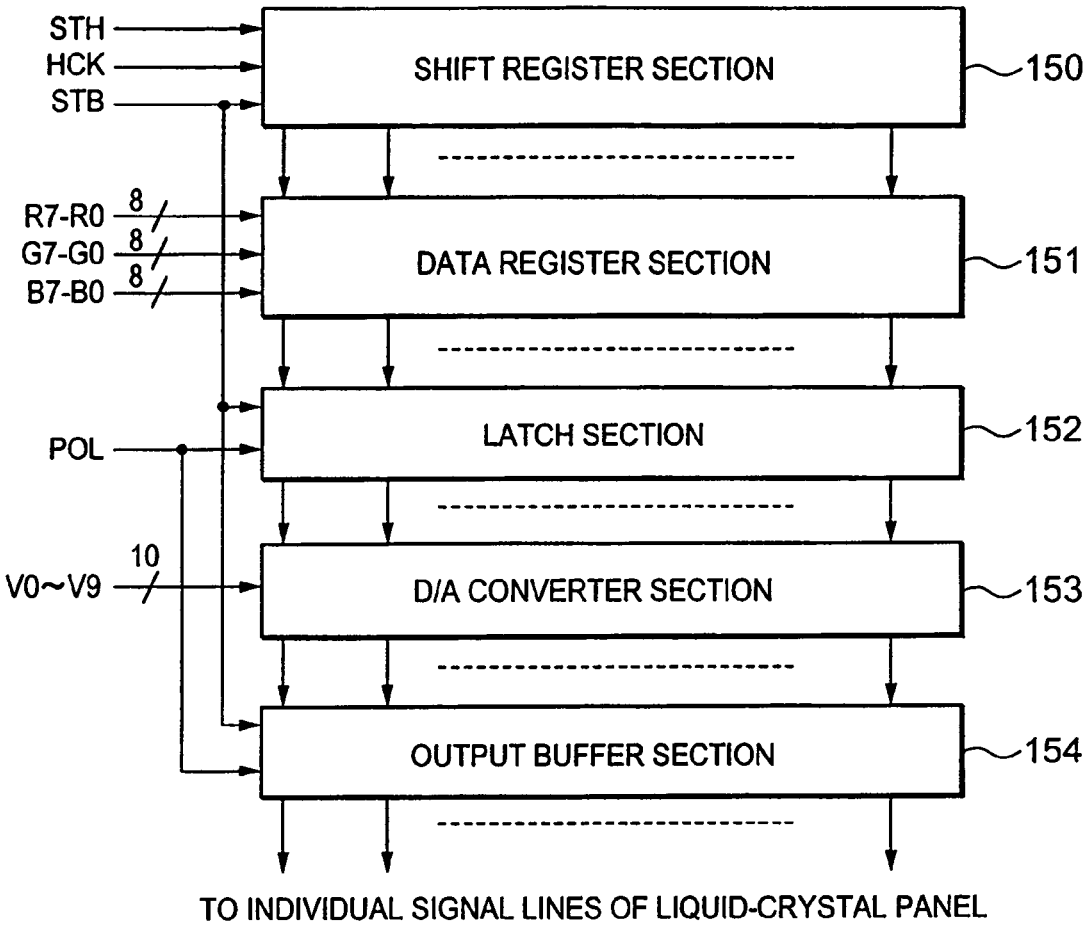
FIG. 12 (PRIOR ART)
FIG. 12 is an illustration showing circuit blocks constituting a signal-line driving circuit section used for a conventional display device.
Figure 22:
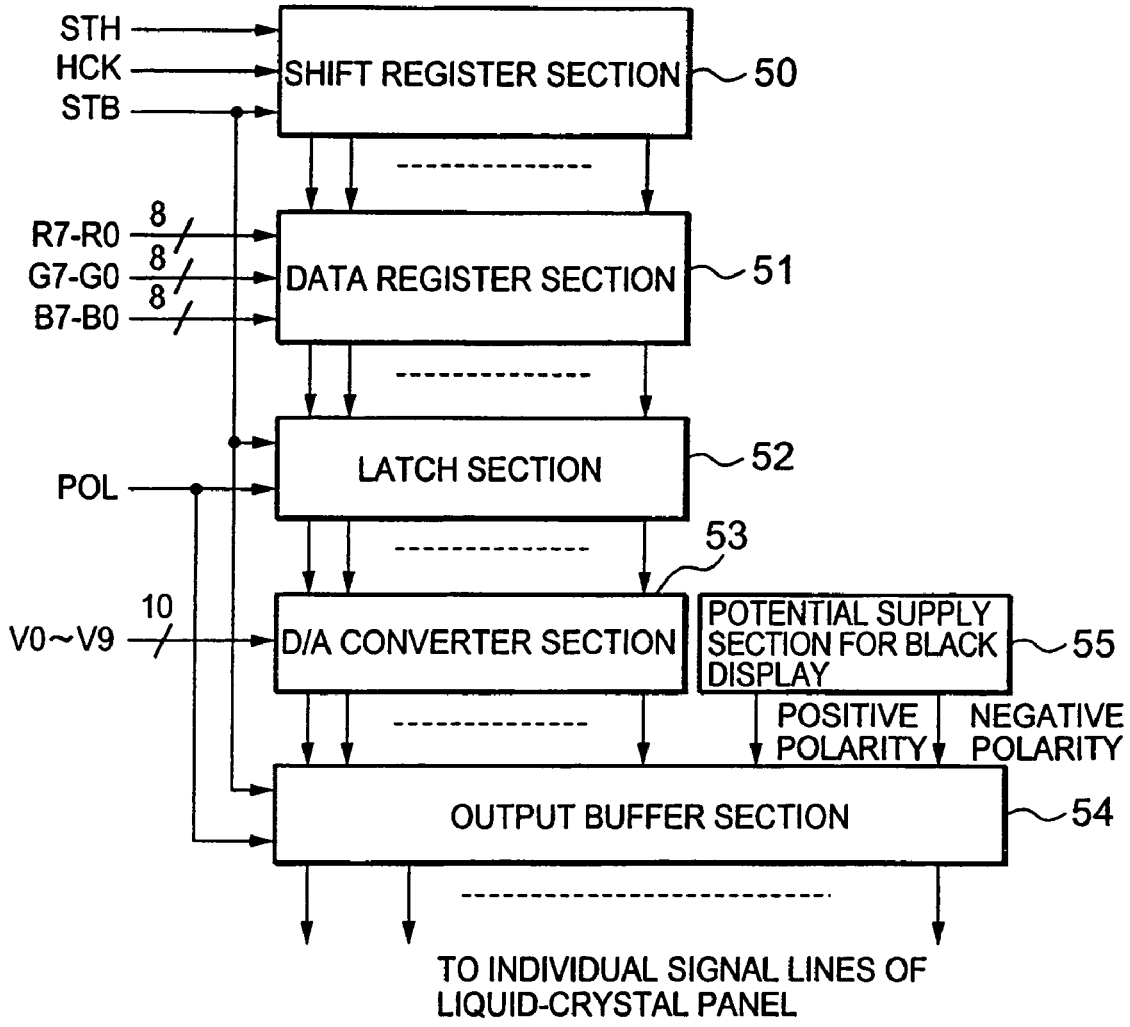
FIG. 22 is an illustration showing circuit blocks constituting a signal-line driving circuit section used for a display device of the embodiment of the invention.

FIG. 22 is a schematic block diagram of a signal-line driving circuit employed in the present invention. A signal-line driving circuit of the present invention is configured to have a potential supply section 55 for black display added to the conventional signal-line driving circuit shown in FIG. 12.

Figure 1:
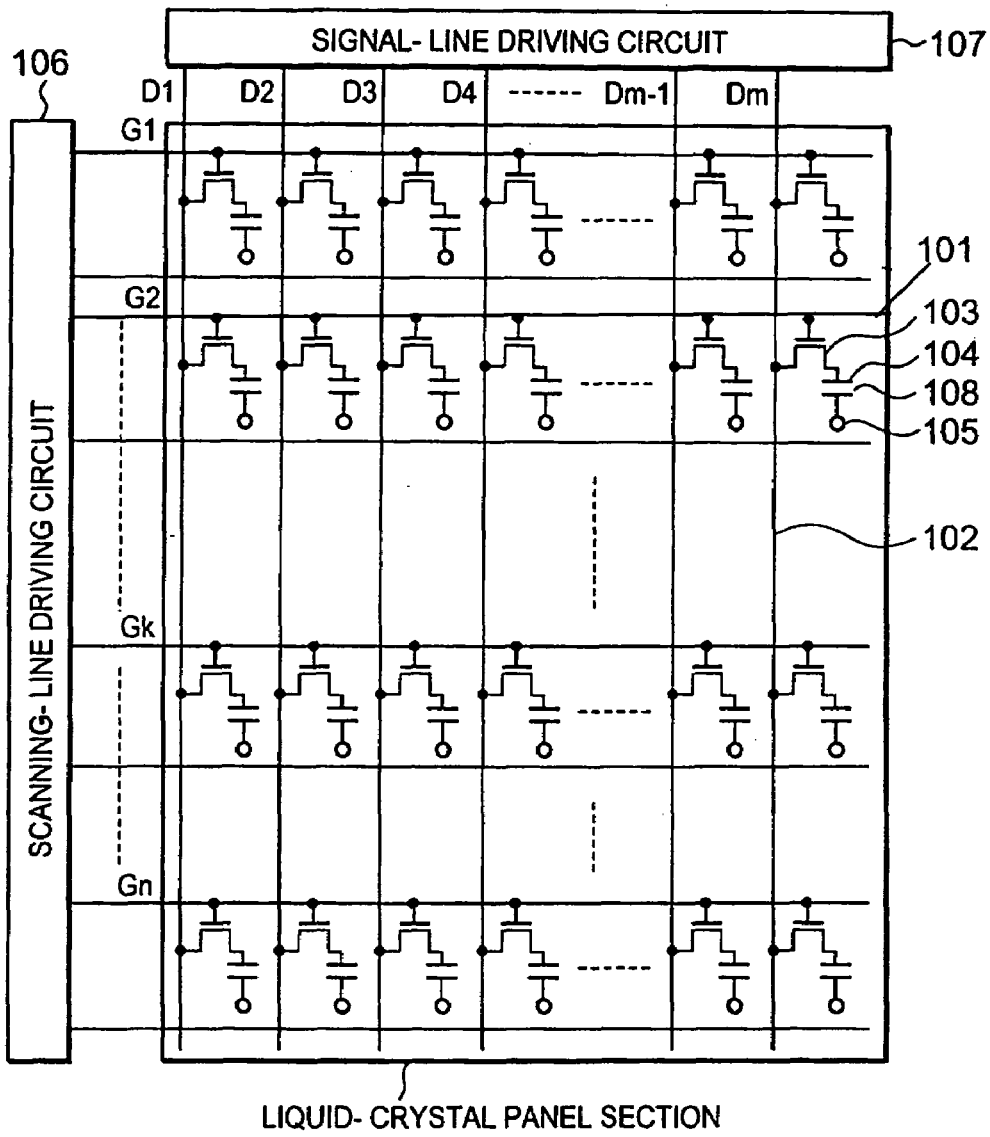
FIG. 1 (PRIOR ART)
FIG. 1 is a schematic configuration of an active matrix substrate circuit of a conventional liquid-crystal panel.
Figure 2:
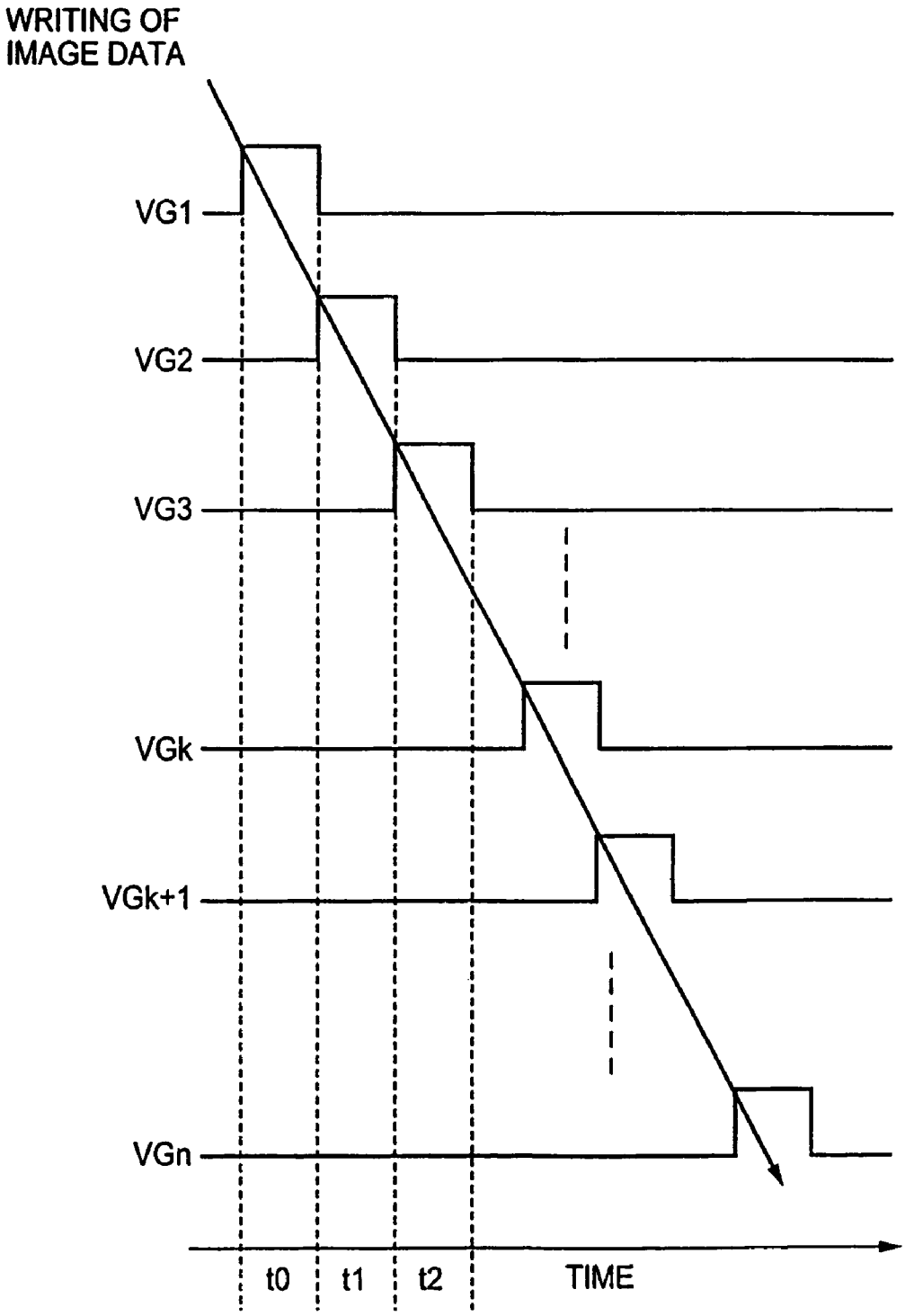
FIG. 2 (PRIOR ART)
FIG. 2 is a timing chart showing a method for driving a scanning line of a conventional display device.
Figure 3:
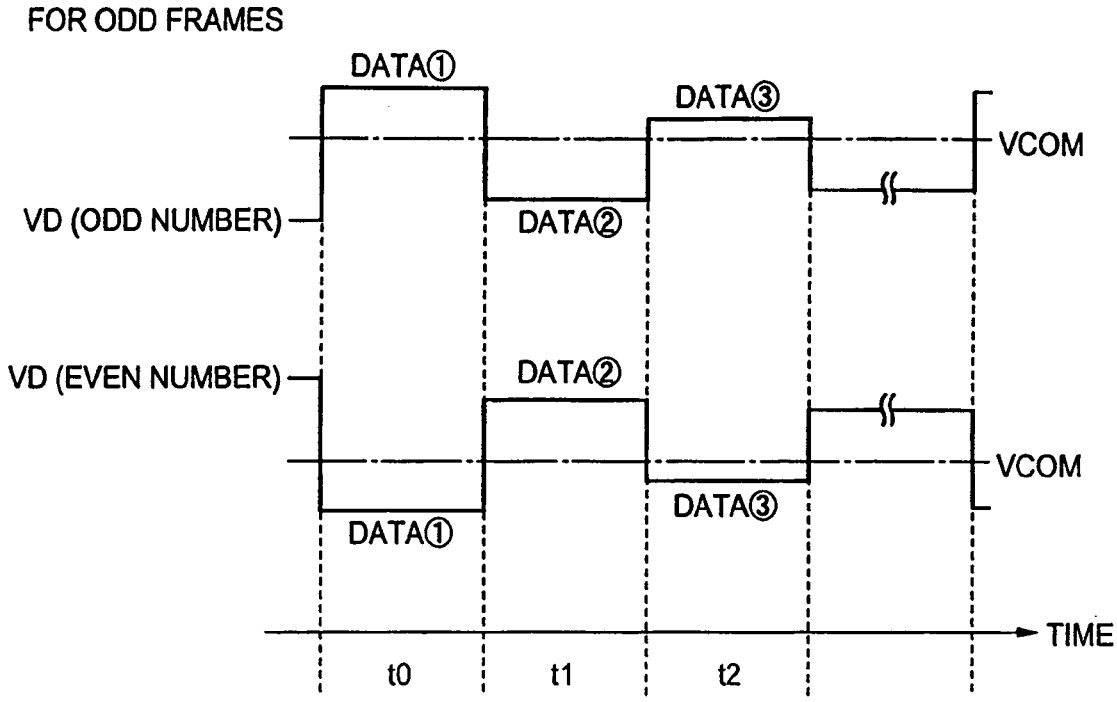
FIG. 3 (PRIOR ART)
FIG. 3 is timing charts an illustrating how signal lines of a conventional display device are driven.
Figure 3:
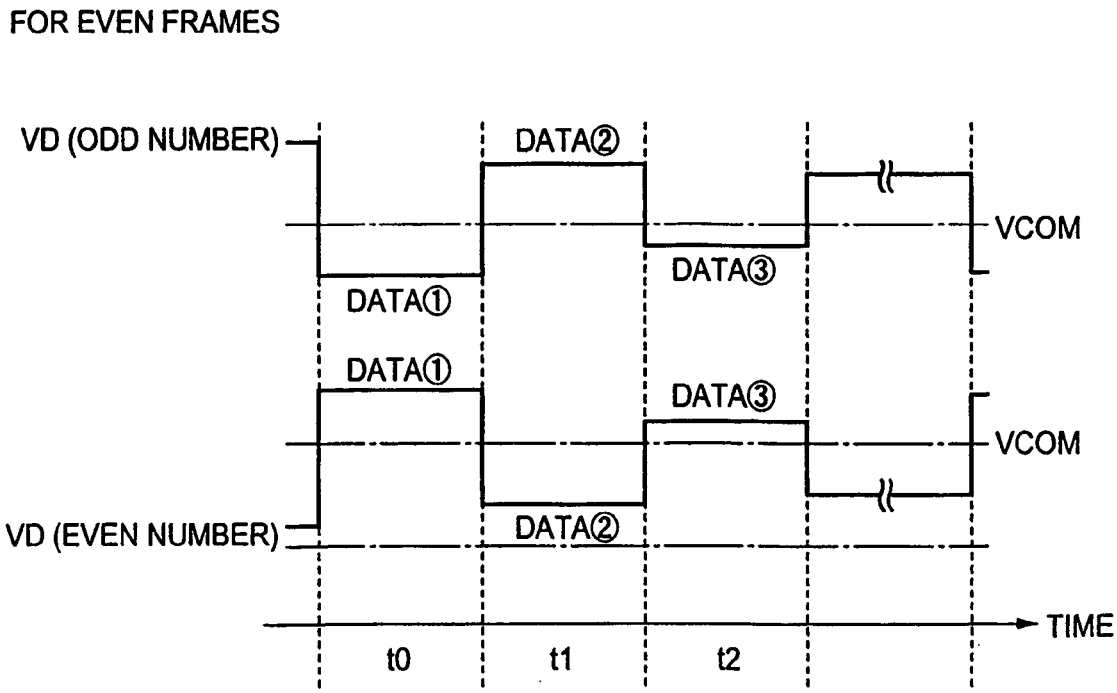
FIG. 3 (PRIOR ART)
Figure 4:
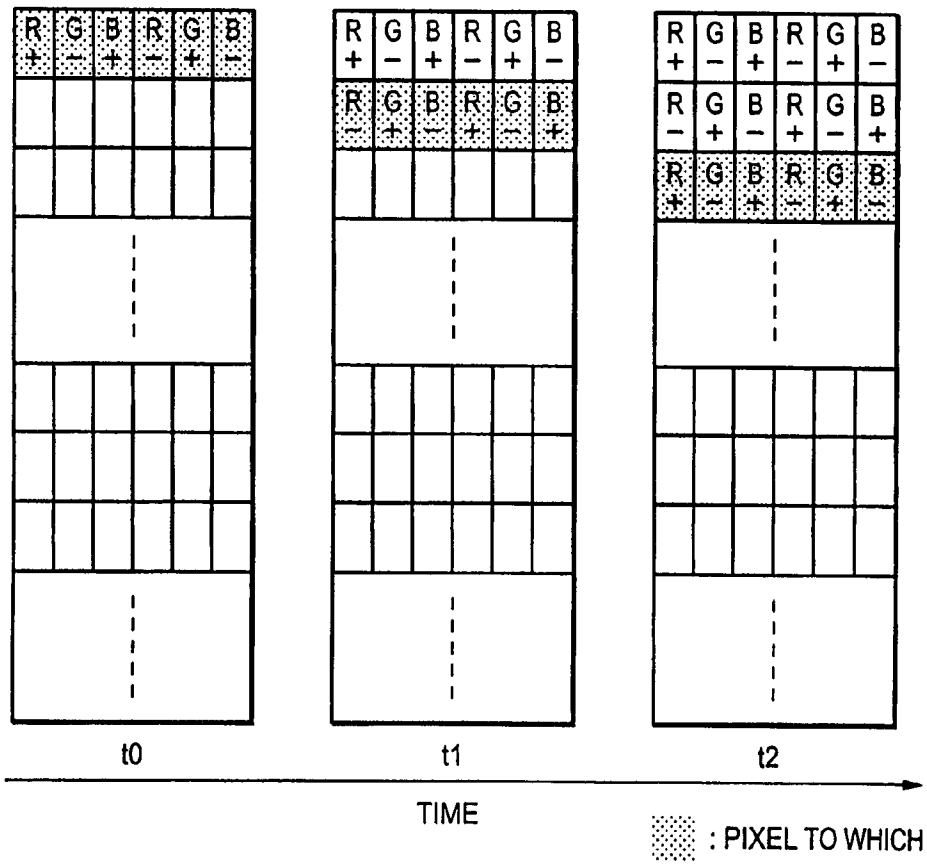
FIG. 4 (PRIOR ART)
FIG. 4 is a schematic view showing how pixel data is written according to a conventional method.
Figure 5:
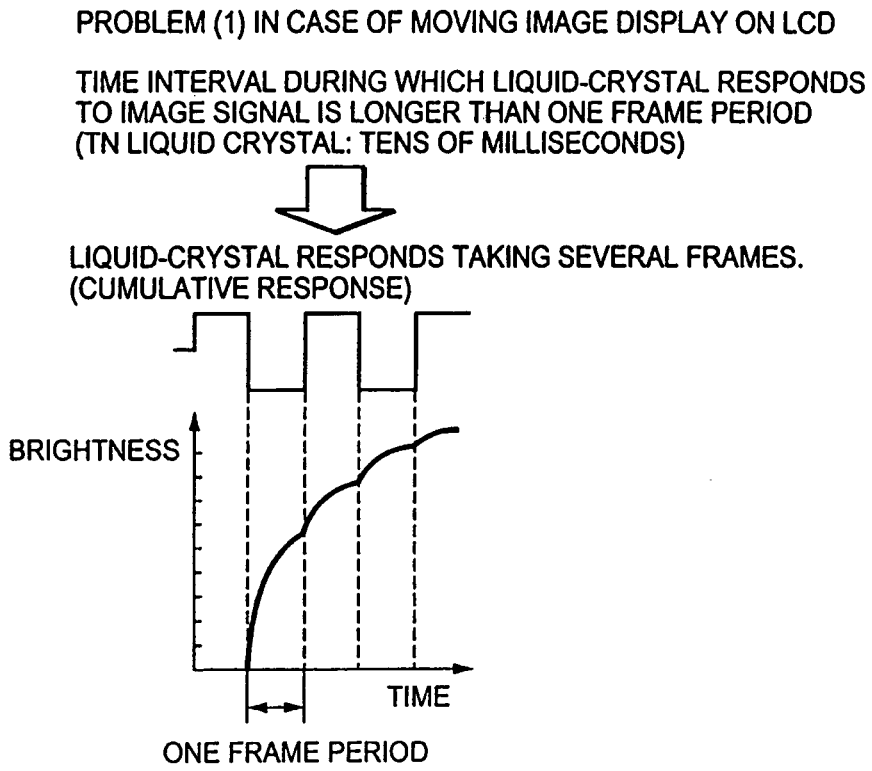
FIG. 5 (PRIOR ART)
FIG. 5 shows how a speed at which liquid crystal responds to an image signal supplied thereto affects the brightness of the display panel.
Figure 6:
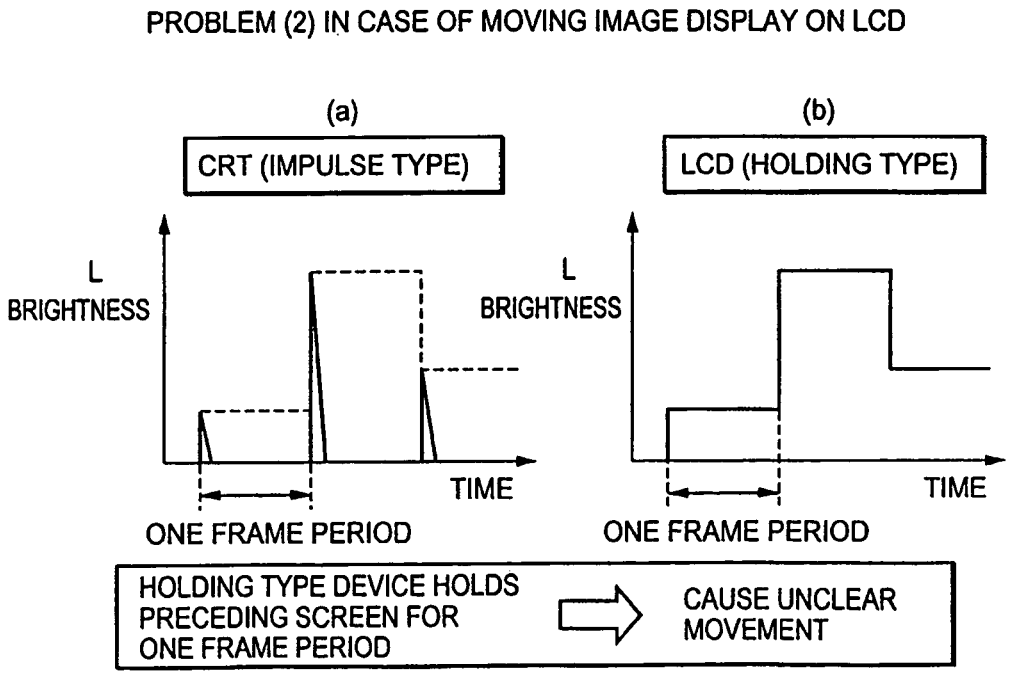
FIG. 6 (PRIOR ART)
FIG. 6(*a*) is presented to illustrate how a pixel of a CRT emits light for image display in response to an image signal in the time domain.
Figure 13:
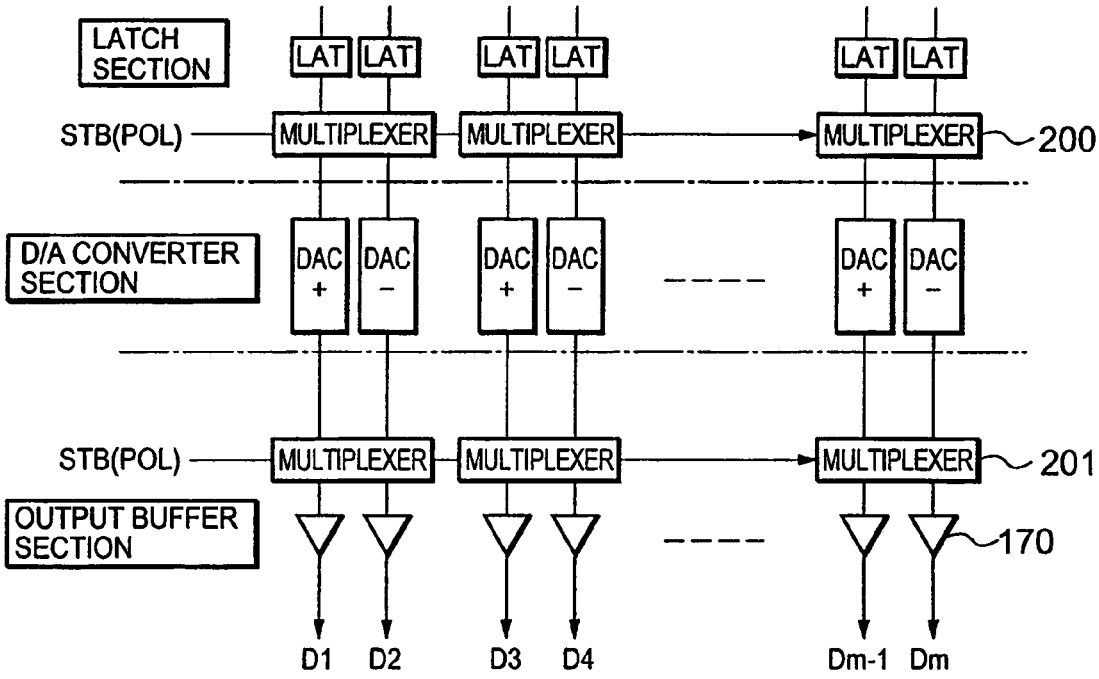
FIG. 13 (PRIOR ART)
FIG. 13 shows a detailed output-section configuration of a signal-line driving circuit of the conventional display device.
Figure 14:
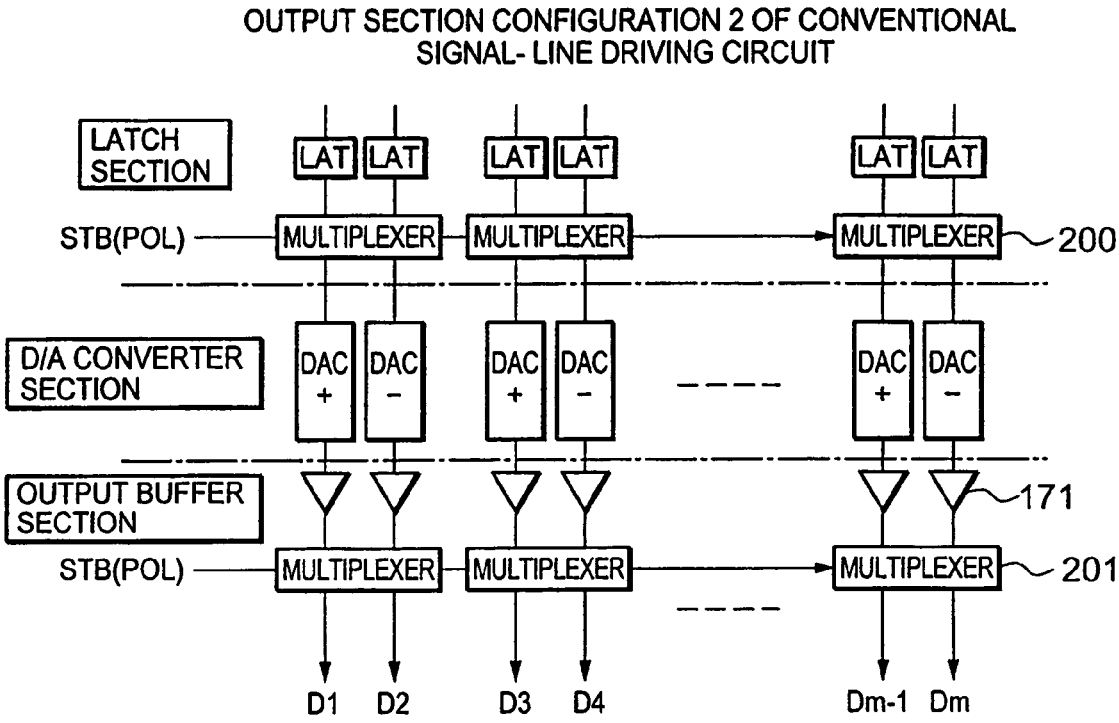
FIG. 14 (PRIOR ART)
FIG. 14 shows another detailed output-section configuration of a signal-line driving circuit of the conventional display device.
Figure 23:
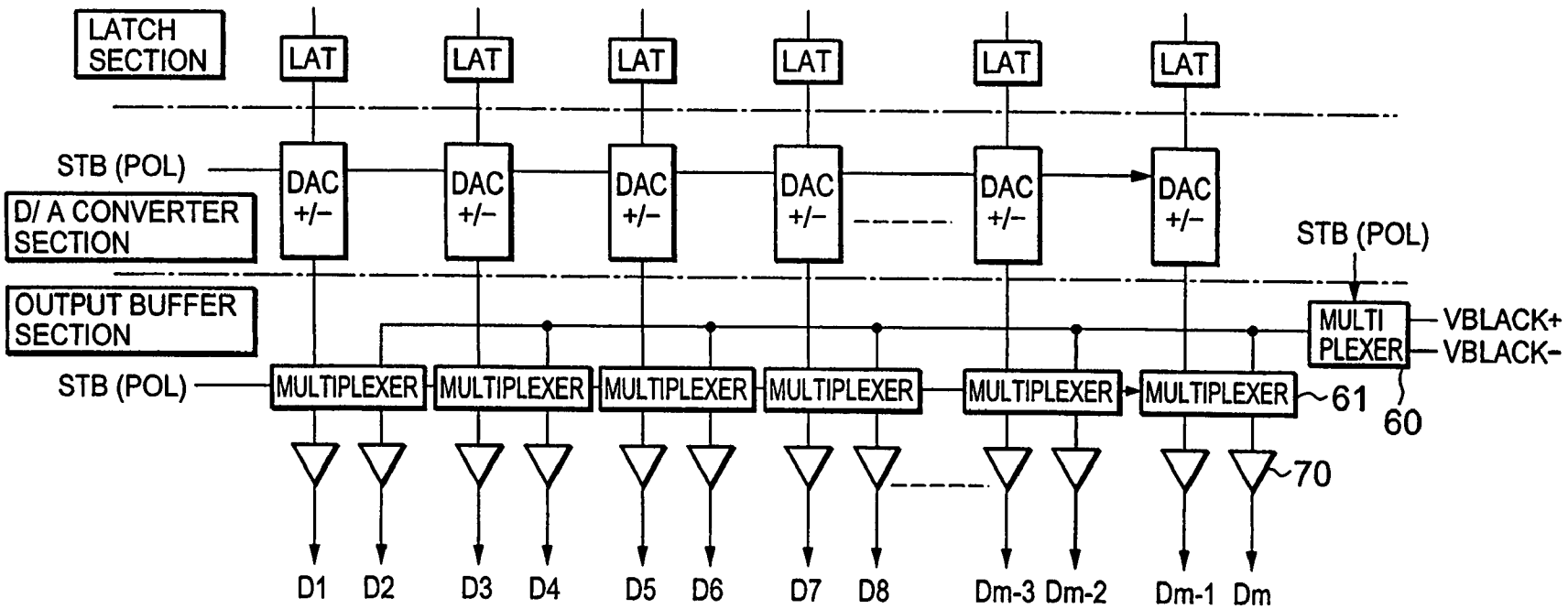
FIG. 23 shows a detailed output-section configuration of a signal-line driving circuit employed in the display device, shown in FIG. 15, of the embodiment of the invention.

FIG. 23 shows detailed output-section configuration in a signal-line driving circuit. The output-section configuration shown in FIG. 23 is employed in a case where a liquid-crystal panel is configured as shown in FIG. 15. As shown in FIG. 23, a latch circuit (LAT) for storing image data is half the size of the corresponding circuit in the conventional signal-line driving circuit (FIG. 13). Moreover, because the polarities of image data output to the signal lines are the same in the circuit shown in FIG. 1 (FIG. 18), DAC+/− is employed which switches its output between a positive-polarity gray scale voltage and a negative-polarity gray scale voltage depending on image data in response to an STB signal. The multiplexer 61 of an output buffer section operates as follows. That is, first, the multiplexer 61 selects one out of a positive-polarity gray scale voltage and negative-polarity gray scale voltage depending on the image data output from DAC+/−. Secondly, it selects one out of a positive-polarity voltage Vblack+ for black display and a negative-polarity voltage Vblack− for black display, both voltages being selected by a multiplexer 60. Thirdly, it outputs the gray scale voltage and the voltage for black display to the two signal lines respectively. Regarding image data to be stored in the LAT, image data to odd-number-th signal lines and image data to the even-number-th signal lines are stored in the LAT every time when the image data are output to the signal lines. Constructing the output-section as shown in FIG. 23 allows the signal line driving circuit to output the waveform shown in FIG. 17.

Figure 24:
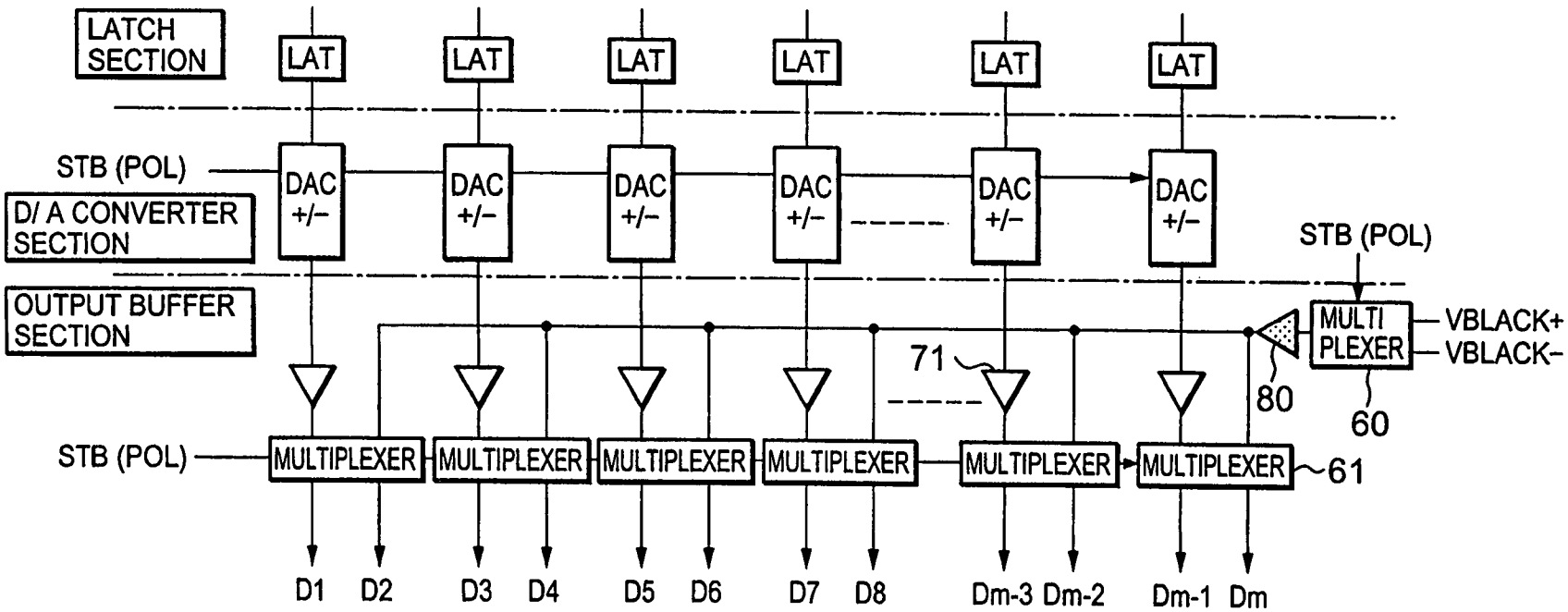
FIG. 24 shows another detailed output-section configuration of the signal-line driving circuit employed in the display device, shown in FIG. 15, of the embodiment of the invention.
Figure 25:
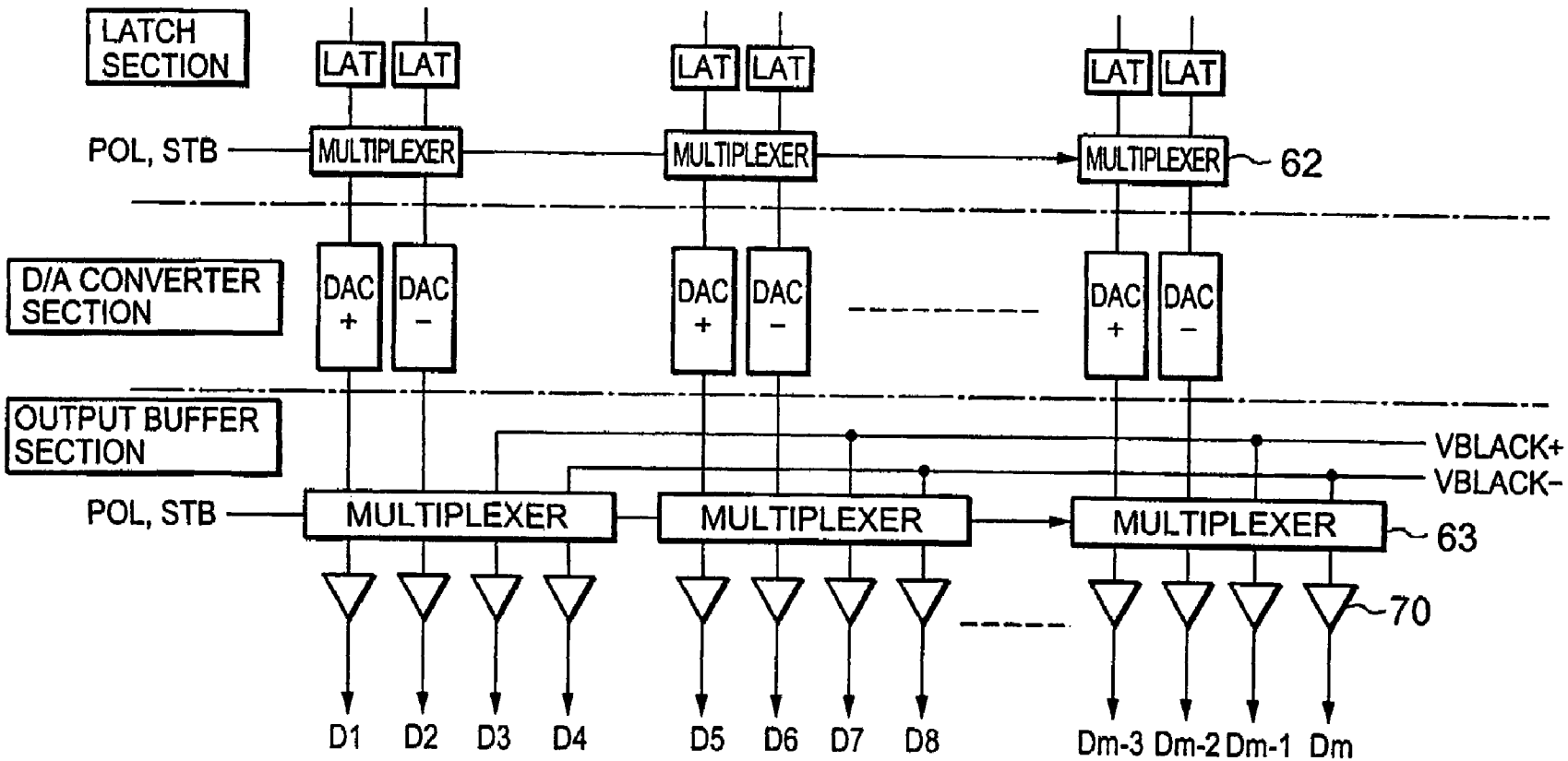
FIG. 25 shows a detailed output-section configuration of a signal-line driving circuit employed in the display device, shown in FIG. 19, of the embodiment of the invention.

Moreover, the signal-line driving circuit of the present invention circuit may be configured as shown in FIG. 24. Because an amplifier 80 for outputting a potential for black display outputs only one of Vblack+ and Vblack−, the amplifier 80 can be realized by an amplifier that needs not a wide dynamic range.

When a liquid-crystal panel section has the configuration shown in FIG. 19, a signal-line driving circuit is configured to have the output-section constructed as shown in FIG. 15. The above signal-line driving circuit is different from the conventional signal-line driving circuit shown in FIG. 13 in that the multiplexer 63 of the output buffer section selects a positive-polarity gray scale voltage corresponding to the image data output from DAC+, a negative-polarity gray scale voltage corresponding to the image data output from DAC−, a positive-polarity voltage Vblack+ for black display, and a negative-polarity voltage Vblack−, and then, outputs the four voltages to the four signal lines. Moreover, the LAT, multiplexer 62, DAC+, and DAC− each are configured to occupy half the area of the corresponding circuits employed in the conventional signal-line driving circuit.

Figure 26:
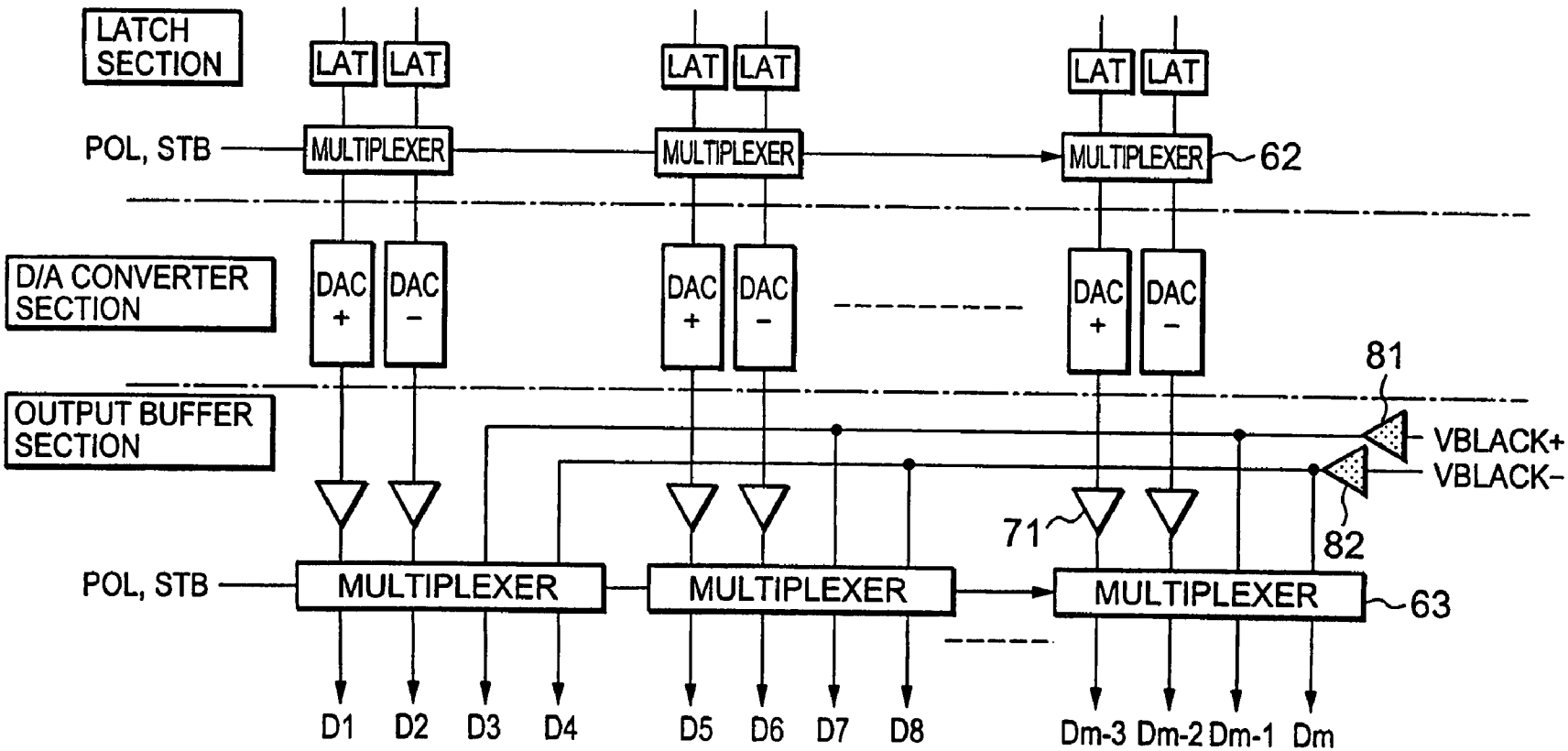
FIG. 26 shows another detailed output-section configuration of the signal-line driving circuit employed in the display device, shown in FIG. 19, of the embodiment of the invention.

In the case of the liquid-crystal panel shown in FIG. 19, the image data stored in the LAT is input to two left or two right signal lines out of four signal lines selected by the multiplexer 63 during each period for output to a signal line. The image data stored in the LAT is processed as follows. That is, first, the image data is input to the multiplexer 62 and then to the multiplexer 63 through the DAC+ or DAC−. Second, the image data is input to the desired signal lines. Third, the positive-polarity potential Vblack+ for black display and negative-polarity potential Vblack− for black display are output to the signal lines other than the desired signal lines, producing the waveforms shown in FIG. 20. Moreover, a signal-line driving circuit of the present invention may be configured as shown in FIG. 26. Because amplifiers 81 and 82 for outputting a potential for black display output only Vblack+ and Vblack− respectively, the amplifiers 81, 82 can be realized by an amplifier that needs not a wide dynamic range.

Employment of the circuit of the present invention allows a latch circuit (LAT) to store data whose size is half the size of the conventional image data used in the conventional signal-line driving circuit (refer to FIG. 13) and therefore, makes it possible to halve the size of chips for other circuit components excluding the latch circuit, i. e., a shift register section 50, data register section 51, and D/A converter section 53 constituting the signal-line driving circuit section shown in FIG. 22, significantly reducing the area of a display device.

As described above, a display device of the present invention makes it possible to prevent an unclear movement of moving image when displaying a moving image and significantly reduce a signal-line driving circuit chip in size, producing significantly beneficial effects in the technical field that needs a reduced size display device.

As described above, according to a display device and its driving method of the present invention, a display device having pixels arranged like a matrix includes a first scanning line for selecting a predetermined pixel in one pixel row of pixels, a second scanning line for selecting other pixel, a scanning-line driving circuit for sequentially selectively driving the first and second scanning lines set to each pixel row, a fist signal line for supplying a voltage corresponding to image data or black image data to a pixel selected by the first scanning line, a second signal line for supplying a voltage corresponding to image data or black image data to a pixel selected by the second canning line, and a signal-line driving circuit for driving the first and second signal lines, in which the scanning-line driving circuit simultaneously drives the first scanning line and a second scanning line for selecting a pixel row different from that selected by the first scanning line, and the signal-line driving circuit simultaneously supplies a voltage corresponding to image data and a voltage corresponding to black image data to pixels of different pixel rows by alternately outputting a voltage corresponding to image data and a voltage corresponding to black image data to the first and second signal lines in accordance with an output timing pulse signal. Therefore, it is enough to hold only the data half of conventional image data in a latch circuit (LAT) and it is possible to approximately halve chip sizes of a shift register section, data register section, and D/A converter section constituting a signal-line driving circuit section in addition to the chip size of a latch circuit and greatly decrease the occupying area of a display device.

As described above, a display device of the present invention makes it possible to prevent an unclear moving image when displaying a moving image and greatly reduce the chip size of a signal-line driving circuit.

What is claimed is:

1. A method for driving a display device including a pixel array with pixels arranged in a matrix of rows and columns, comprising the steps of:

dividing a period of writing image data to at least one pixel row among pixel rows constituting said pixel array into a first scanning period and a second scanning period;

writing image data to pixels located in predetermined pixel columns in an optional pixel row during said first scanning period and further writing black image data to pixels located in pixel columns other tan said predetermined pixel columns and included in a pixel row different from said optional pixel row; and writing image data to pixels excluding said pixels during said first scanning period allowing image data to be written thereto and located in said optional pixel row during said first scanning period and further writing black image data in pixels excluding said pixels allowing said black image data to be written thereto and included in said pixel row during said second scanning period.

2. The method for driving a display device according to claim 1, wherein said pixel row allowing said black image data to be written thereto during said first scanning period and said pixel row allowing said black image data to be written thereto during the second scanning period are different from each other.

3. A display device including a pixel array with pixels arranged in a matrix of rows and columns comprising:

a first scanning line for selecting one set of pixels in one pixel row, said one pixel row constituting said pixel array;

a second scanning line for selecting the other set of pixels in said one pixel row;

a scanning-line driving circuit for driving sets of first and second scanning lines in order from top to bottom within said pixel array, each set of first and second scanning lines corresponding to each of individual pixel rows of said pixel array;

a first set of signal lines for supplying a voltage corresponding to one of image data and black image data to pixels selected by said first scanning line out of one set of first and second scanning lines the second scanning line a second set of signal lines for supplying a voltage corresponding to one of image data and black image data to pixels selected by said second scanning line out of said one set of first and second scanning lines; and a signal-line driving circuit for driving said sets of first and second signal lines, said sets of first and second signal lines constituting entire signal lines;

wherein said scanning-line driving circuit simultaneously drives said first scanning line out of said one set of first and second scanning lines and a second scanning line said out of another set of first and second scanning lines and wherein said signal-line driving circuit simultaneously outputs one of voltages corresponding to image data and black image data to said first set of signal lines and the other thereof to said second set of signal lines, and wherein said signal-line driving circuit writes a voltage corresponding to image data and a voltage corresponding to black image data into pixels included in two pixel rows different from each other.

4. The display device according to claim 3, wherein a pair of a pixel selected by said first scanning line and a pair of a pixel selected by said second scanning line is disposed in each set of adjacent pixel columns, each pixel column out of said each set of adjacent pixel columns being consisting of a plurality of pixels.

5. The display device according to claim 3, wherein the number of each of said first and second sets of signal lines is made equal to half the number of said entire signal lines so that the number of pixels selected by a first signal line out of one set of first and second scanning lines and the number of pixels selected by a second signal line out of one set of first and second scanning lines become equal to each other.

6. The display device according to claim 3, wherein said signal-line driving circuit comprises a shift register circuit having shift stages corresponding to half the number of said entire signal lines and storing image data sequentially input thereto while shifting locations to be allocated to said data within said shift register circuit, a latch circuit for latching all together image data corresponding to half the number of said entire signal lines and output from said shift stages of said shift register circuit and ten outputting image data, a D/A converter for converting image data stored in said latch circuit and corresponding to half the number of said entire signal lines into gray scale voltages in a manner depending on characteristics of display device, and a buffer for outputting voltages corresponding to image data corresponding to half the number of said entire signal lines and output from said D/A converter to specific signal lines and outputting a voltage corresponding to black image data to signal lines other than said specific signal lines.

7. The display device according to claim 6, wherein said signal-line driving circuit has a multiplexer for selecting voltages corresponding to image data and black image data, and outputting said voltages to said entire signal lines.

8. A display device, comprising:

a first set of signal nodes;

a second set of signal nodes;

a driving circuit for driving, during a first period, said first set of signal nodes with voltages corresponding to image data and said second set of signal nodes with a predetermined voltage wherein said signal nodes are arranged in a matrix and said first set of signal nodes and second set of signal nodes are in different columns in said matrix of signal nodes;

wherein said driving circuit further drives, during a second period following said first period, said first set of signal nodes with said predetermined voltage and said second set of signal nodes with said voltages corresponding to said image data; and wherein said driving circuit includes a second multiplexer receiving a first black image voltage of a first polarity relating to said predetermined voltage and a second black image voltage of a second polarity relating to said predetermined voltage and output said predetermined voltage.

9. The display device as claimed in claim 8, wherein said driving circuit includes an amplifier coupled between a first multiplexer and said second multiplexer.

10. The display device as claimed in claim 8, wherein said driving circuit includes at least one first multiplexer coupled to one of said first set of signal nodes and one of said second set of signal nodes, said first multiplexer receiving one of said voltages corresponding to said image data and said predetermined voltage.

11. The display device as claimed in claim 10, wherein said first multiplexer is controlled in response to a polarity signal.

12. The display device as claimed in claim 8, wherein said driving circuit includes a digital analog converter receiving digital image data to output said voltage corresponding to said image data.

13. The display device as claimed in claim 12, wherein said driving circuit includes an amplifier coupled to the output of said second multiplexer.

14. A display device, comprising:

a first set of signal nodes;

a second set of signal nodes;

a driving circuit for driving, during a first period, said first set of signal nodes with voltages corresponding to image data and said second set of signal nodes with a predetermined voltage wherein said signal nodes are arranged in a matrix and said first set of signal nodes and second set of signal nodes are in different columns in said matrix of signal nodes;

wherein said driving circuit includes a digital analog converter receiving digital image data to output said voltage corresponding to said image data;

wherein said driving circuit further drives, during a second period following said first period, said first set of signal nodes with said predetermined voltage and said second set of signal nodes with said voltages corresponding to said image data; and wherein said driving circuit includes an amplifier coupled between a first multiplexer and said digital analog converter.

15. A display device, comprising:

a first set of signal nodes;

a second set of signal nodes;

a driving circuit for driving, during a first period, said first set of signal nodes with voltages corresponding to image data and said second set of signal nodes with a predetermined voltage wherein said signal nodes are arranged in a matrix and said first set of signal nodes and second set of signal nodes are in different columns in said matrix of signal nodes; and wherein said driving circuit includes at least one multiplexer receiving a first voltage of a first polarity corresponding to an image data, a second voltage of a second polarity corresponding to said image data, a third voltage of said first polarity relating to said predetermined voltage and a fourth voltage of said second polarity relating to said predetermined voltage.

16. The display device as claimed in claim 15, wherein said driving circuit includes a digital analog converter outputting said first and second voltages in response to a digital image signal.

17. The display device as claimed in claim 16, wherein said driving circuit includes an amplifier coupled to the output of said multiplexer to amplify said first to fourth voltages.

18. The display device as claimed in claim 17, wherein said driving circuit includes an amplifier coupled between said digital analog converter and said multiplexer.

* * * * *

UNITED STATES PATENT AND TRADEMARK OFFICE

CERTIFICATE OF CORRECTION

PATENT NO. : 7,148,885 B2
APPLICATION NO. : 10/453020
DATED : December 12, 2006
INVENTOR(S) : Takashi Nose It is certified that error appears in the above-identified patent and that said Letters Patent is hereby corrected as shown below:

Claim 1, Col. 10, line 4, "columns other tan said predetermined" should be --columns other than said predetermined--.

Claim 3, Col. 10, line 30, "array. each" should be --array, each--.

Claim 6, Col. 11, line 12, "and ten outputting" should be --and then outputting--.

Signed and Sealed this

Ninth Day of March, 2010

David J. Kappos

David J. Kappos
*Director of the United States Patent and Trademark Office*